US006550885B2

(12) United States Patent
Matsumoto et al.

(10) Patent No.: US 6,550,885 B2
(45) Date of Patent: Apr. 22, 2003

(54) INK JET RECORDING DEVICE AND INK DROP JETTING INSPECTION METHOD FOR THE INK JET RECORDING DEVICE

(75) Inventors: Hitoshi Matsumoto, Nagano (JP); Hironori Endo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/936,419

(22) PCT Filed: Jan. 9, 2001

(86) PCT No.: PCT/JP01/00044

§ 371 (c)(1),
(2), (4) Date: Feb. 14, 2002

(87) PCT Pub. No.: WO01/51287

PCT Pub. Date: Jul. 19, 2001

(65) Prior Publication Data

US 2003/0007026 A1 Jan. 9, 2003

(30) Foreign Application Priority Data

| | | |
|---|---|---|
| Jan. 12, 2000 | (JP) | 2000-003937 |
| Jun. 21, 2000 | (JP) | 2000-186049 |
| Dec. 7, 2000 | (JP) | 2000-372609 |
| Dec. 7, 2000 | (JP) | 2000-372610 |
| Dec. 21, 2000 | (JP) | 2000-389224 |

(51) Int. Cl.[7] ..... B41J 29/393; B41J 29/38; B41J 2/165

(52) U.S. Cl. ..... 347/19; 347/14; 347/35; 347/36

(58) Field of Search ..... 347/19, 14, 23, 347/16, 15, 35, 36, 10, 12, 11, 85, 86, 89

(56) References Cited

U.S. PATENT DOCUMENTS 5,455,608 A * 10/1995 Stewart et al. ..... 347/23

FOREIGN PATENT DOCUMENTS

JP 10 226 090 A * 8/1998 ..... B41J/2/175

* cited by examiner

*Primary Examiner*—Lamson Nguyen
*Assistant Examiner*—Charles W. Stewart
(74) *Attorney, Agent, or Firm*—Sughrue Mion, PLLC

(57) ABSTRACT

In an ink jet recording apparatus, an ink collection unit is disposed on a moving path of a recording head for receiving ink drops ejected from the recording head to which a flushing drive signal is supplied. The ink collecting unit is formed with an aperture through which the ink drops ejected from the recording head pass, and an air flow passage. A ventilation fan is disposed on the way of the air flow passage or a termination end portion of the air flow passage so that ink mist generated when the flushing operation is performed is efficiently collected in the ink collecting unit.

41 Claims, 17 Drawing Sheets

INK JET RECORDING DEVICE AND INK DROP JETTING INSPECTION METHOD FOR THE INK JET RECORDING DEVICE

TECHNICAL FIELD

The present invention relates to an ink jet recording apparatus provided with an ink jet recording head for use in forming images on recording paper by ejecting ink drops from nozzle orifices, and a flushing region disposed on a head moving path for receiving the ink drops ejected when a flushing driving signal is supplied to the recording head, and more particularly to an ink jet recording apparatus provided with an ink collecting unit for effectively collecting unnecessary mist (atomized ink) resulting from fine ink drops produced during the flushing operation.

The present invention relates to an ink jet recording apparatus provided with an ink collecting unit for effectively collecting unnecessary mist (atomized ink) resulting from ink drops produced at the time of inspecting an ink ejecting condition so as to detect any unoperating nozzle by checking the presence or absence of the ink drops ejected from nozzle orifices of a recording head.

The present invention relates to an ink jet recording apparatus in which at the time of inspecting an ink ejecting condition so as to detect any unoperating nozzle, it is ensured that such an unoperating nozzle can be detected and an inspecting method used in the apparatus.

DESCRIPTION OF RELATED ART

Ink jet recording apparatus are now widely used for printing including color printing partly because relatively less printing noise is produced and partly because high-density small dots are formable. The ink jet recording apparatus of this type is generally provided with an ink jet recording head mounted on a carriage and used for scanning recording paper in its width direction and a paper feeder for moving the recording paper in a direction perpendicular to the scanning direction of the recording head. Then recording is performed by ejecting ink drops from the recording head onto the recording paper according to printing data.

Further, not only text printing with black ink but also full-color printing can be performed by continuously supplying, to the recording head, black ink and three kinds of color ink of yellow, cyan and magenta, for example, by varying the ejection ratios of these different kinds of color ink.

In view of the fact that the ink jet recording apparatus like this is used for printing by ejecting the ink pressurized in a pressure generating chamber from nozzle orifices as ink drops onto recording paper, there may develop poor-quality printing due to a rise in ink viscosity originating from evaporation of an ink solvent from the nozzle orifices, solidification of ink, adhesion of dust, mixture of bubbles and so forth. For this problem of poor-quality printing, the ink jet recording apparatus is provided with a head cap for sealing the nozzle orifices of the recording head and a wiper for cleaning the nozzle forming face as occasion demands while printing is not performed.

The head cap serves as not solely a cover member for preventing the ink of the nozzle orifices of the recording head from being dried out while printing is suspended but also what receives negative pressure from a suction pump when the nozzle orifices are clogged so as to suck and discharge the ink from the nozzle orifices whereby to solve the problem of clogging due to the solidification of ink in the nozzle orifices and the problem of an unsatisfactory ejection of ink resulting from the introduction of bubbles into an ink channel.

The process of forcing the ink to be sucked and discharged so as to solve the problems of clogging of the recording head and of the introduction of bubbles into the ink channel is called a cleaning operation, which is performed, for example, in case where printing is performed again after a long suspension of the operation of the recording apparatus or in case where the user depresses, for example, a cleaning switch after recognizing the deterioration of printed image quality. The cleaning operation is accompanied with the operation of wiping the nozzle forming face of the recording head with the wiper formed of an elastic plate of rubber or the like after the ink is caused to be sucked and discharged from the recording head.

A function of causing ink drops to be ejected by applying a driving signal to the recording head is also retained, though the driving signal is irrelevant to printing, which is called a flushing operation. The flushing operation is performed periodically to recover irregular meniscuses produced in the vicinity of the nozzle orifices of the head through the wiping operation of the wiper and to prevent any nozzle orifice ejecting few ink drops from being clogged with extremely viscous ink while printing is performed.

FIG. 5 shows an example of a conventional ink jet recording apparatus so arranged that during the flushing operation, ink drops are ejected toward a flushing region formed on a head moving path.

In FIG. 5, reference numeral 1 denotes a carriage so arranged as to be guided by a guide shaft 4 supported by left and right frames 2 and 3 via a timing belt driven by a carriage motor (not shown) and reciprocated in the axial direction of the guide shaft 4.

The carriage 1 is loaded with an ink jet recording head 5 directed downward, a detachable black ink cartridge 6 and a detachable color ink cartridge 7 for supplying ink to the recording head 5 being also mounted thereon. Under the recording head 5 lies a platen 8 that extends in the scanning direction of the recording head 5 so that recording paper 9 mounted on the platen 8 can be moved by a paper feeder (not shown) successively in a direction perpendicular to the scanning direction of the recording head 5.

Reference numeral 10 denotes a head cap that is disposed in a non-printing region (home position). When the recording head 5 is placed just above the head cap 10, it is moved upward so as to seal the nozzle forming face of the recording head 5. A suction pump 11 for providing negative pressure to the internal space of the head cap 10 is also disposed under the head cap 10.

As described above, the head cap 10 serves as not solely a cover member for preventing the nozzle orifices of the recording head 5 from being dried out during the suspension of operation of the recording apparatus but also a cleaner for causing ink to be sucked and discharged by making the negative pressure from the suction pump 11 act on the recording head 5.

Further, a wiper 12 formed of an elastic plate of rubber or the like is disposed in the vicinity of the head cap 10 and the operation of wiping the nozzle forming face of the recording head 5 is performed thereby when the carriage 1 moves toward the head cap 10.

On the other hand, a flushing region 13 is formed in the vicinity of the other end opposing to the head cap 10 via the central printing region, The flushing region 13 is formed of an aperture in such a manner as to pass through the platen 8. Further, part of a waste-ink absorber 14 for absorbing the ink discharged via the pump 11 from the head cap 10 is disposed in the inner base portion of the aperture forming the flushing region 13. The absorber 14 extends along the platen 8 and is contained in a casing member, that is, a waste-ink tank 15.

In the recording apparatus, flushing is performed periodically as described above to prevent an unsatisfactory ejection of ink resulting from an increase in ink viscosity in an unused nozzle while printing is performed. Flushing is performed in each nozzle orifice with a frequency of about tens of shots every several seconds on average. The flushing operation may be performed with from thousands to tens of thousands shots from each nozzle periodically, depending on the timing after the cleaning operation for the prevention of mixture of colors is performed, the timing in the beginning of printing or while printing is performed.

When the aperture is formed in the platen 8 as the flushing region 13 of FIG. 5, the distance from the nozzle forming face of the recording head 5 up to the waste-ink absorber 14 is approximately tens of millimeters and the flying distance of ink inevitably increases. Consequently, some of ink drops ejected from the nozzle orifices of the recording head are reduced to mist (atomized ink) because of air resistance and become afloat as shown by arrows and the problem in this case is that the inside and outside of the apparatus, to say nothing of recording paper, are contaminated.

In order to prevent the occurrence of such a problem as mentioned above, the provision of the waste-ink absorber in a position close to the recording head may be considered. However, there normally exist mechanisms such as the paper feeding roller in a portion opposite to the head within the traveling range of carriage, so that a sufficient capacity is actually unavailable. Moreover, the ink drops ejected from the nozzle orifices are electrically charged to no small extent and affected by the static electricity generated in the driving portion within the recording apparatus and also accelerated by an air flow because of a ventilation fan disposed so as to suppress a temperature rise within the apparatus or an air flow accompanying the movement of the carriage. Therefore, the problem of contaminating the inside and outside of the recording apparatus as well as the recording paper still remains to be solved. In the recent recording apparatus so arranged as to minimize the amount of each ink drop under control to realize high image quality in particular, the problem like this appears conspicuous.

Due to a rise in ink viscosity and the solidification of ink originating from the evaporation of the ink solvent from the nozzle orifices and the introduction of bubbles into the nozzle orifices, the problem of causing ink drops to be unsatisfactorily ejected is still left unsolved. In case where the situation above is produced, so-called dot omission found in printed images results in deteriorating their quality and there has been proposed a recording apparatus provided with an ejecting condition inspector (ejecting condition detector) for optically inspecting whether the dot omission occurs.

The ejecting condition inspector essentially consists of a combination of a light emitting element for emitting light beams and a light receiving element for receiving the light beams from the light emitting element and operates to emit the light beams sequentially in a manner crossing the flying courses of the ink drops ejected from the nozzle orifices of the recording head. While controlling the ejection of ink drops from the nozzle orifices of the recording head in time series, the ejecting condition detector detects the quantity of light in the light receiving element whereby to specify the unsatisfactory ejecting condition of ink drops in each of the nozzle orifices.

As the above-described optical detector (ejecting condition detector) is used to inspect the ejecting condition in a manner corresponding to each of the many nozzle orifices thus oriented, the light emitted from a light emitting module to a light receiving module is converged into what has a very small diameter (1 mm or less).

On the other hand, an ink ejection similar to the above-described flushing operation is performed from each of the nozzle orifices (nozzle-forming face) and the ink drops thus ejected drop in the gravitational direction within the ejecting condition detector (ejecting region). However, most of the ink drops are changed into ink mist (atomized ink) as in the above-described case and become afloat in the ejecting condition detector. As a result, the light emitting and light receiving modules tend to become easily contaminated by the ink mist and the problem in this case is that reliability from the standpoint of the detection of the ejecting condition lowers.

Moreover, the ejecting condition may be detected so as to detect any unoperating nozzle orifice after the cleaning operation is performed. In making this inspection, there is found a nozzle orifice whose operation is unstable among the nozzle orifices immediately after the cleaning operation is performed though the reason for this is not obvious and it has not been ensured that such an unoperating nozzle orifice can be detected.

More specifically, because ink is still unstably ejected from the unoperating nozzle orifice at the time of inspecting the ejection of ink drops, that nozzle orifice cannot be detected as an unoperating nozzle orifice and the problem in this case is that satisfactory printing is unavailable as no stable ejection is obtainable when the printing is performed thereafter.

DISCLOSURE OF THE INVENTION

A first object of the present invention made in view of the foregoing problems is to provide an ink jet recording apparatus equipped with an ink collecting unit capable of effectively collecting ink mist floating in the form of fine drops while a flushing operation is performed.

A second object of the present invention made with close attention directed to the foregoing problems is to provide an ink jet recording apparatus capable of preventing a light emitting module and a light receiving module from being contaminated by ink mist and also capable of improving reliability from the standpoint of the detection of an ejecting condition.

A third object of the present invention made with close attention directed to the foregoing problems is to provide an ink jet recording apparatus capable of ensuring that an ejection of ink drops is inspected after a cleaning operation is performed and to provide a method of inspecting an ejection of ink drops.

In order to accomplish the first object, according to the invention, there is provided an ink jet recording apparatus, comprising:

- a carriage, which moves in a widthwise direction of recording paper;
- an ink jet recording head, mounted on the carriage and provided with nozzle orifices for ejecting ink drops to form an image on the recording paper; and an ink collecting unit, placed on a moving path of the recording head for receiving ink drops ejected from the recording head to which a flushing drive signal is supplied; the ink collecting unit including: an unit box formed with an aperture through which the ink drops ejected from the recording head to which the flushing drive signal is supplied; an air flow passage; and a ventilation fan, placed on the way of the air flow passage or a termination end portion of the air flow passage.

Here, it is preferable that the air flow passage extends meandering in a vertical direction.

In order to accomplish the first object, according to the invention, there is also provided an ink jet recording apparatus, comprising:

a carriage, which moves in a widthwise direction of recording paper;

an ink jet recording head, mounted on the carriage and provided with nozzle orifices for ejecting ink drops to form an image on the recording paper; and an unit box, placed on a moving path of the recording head for receiving ink drops ejected from the recording head to which a flushing drive signal is supplied, the unit box formed with an aperture through which the ink drops ejected from the recording head to which the flushing drive signal is supplied, and an air flow passage, which extends meandering in a plurality of directions.

Here, it is preferable that the air flow passage extends meandering in a vertical direction.

In order to accomplish the second object, according to the invention, there is provided an ink jet recording apparatus, comprising:

a carriage, which moves in a widthwise direction of recording paper;

an ink jet recording head, mounted on the carriage and provided with nozzle orifices for ejecting ink drops to form an image on the recording paper;

an ejecting condition detector, placed on a moving path of the recording head, the ejecting condition detector including:

a light emitting module and a light receiving module, which detects an ejecting condition of ink drops ejected from the nozzle orifices; and an ink ejecting region, placed between the light emitting module and the light receiving module for receiving ink drops ejected from the recording head; and a unit box, which faces to the ink ejecting region for collecting ink in the ink ejecting region, the unit box formed with an air flow passage therein.

Preferably, the unit box is formed with an aperture through which ink drops ejected from the recording head to which a flushing drive signal is supplied. Here, the air flow passage extends meandering in a vertical direction.

Preferably, the unit box is provided with a ventilation fan disposed on the way of the air flow passage or a termination end portion of the air flow passage.

In order to accomplish the first and second objects, it is preferable that the air flow passage extends from the aperture while meandering in a gravitational direction and a counter-gravitational direction.

Here, it is preferable that the air flow passage extends from the aperture toward a conter-gravitational direction while an ink collecting space is formed so as to extend from the aperture in the gravitational direction. Further, the ink collecting space has a bottom formed with a discharging port from which collected waste ink is discharged.

On the other hand, preferably, a plurality of plate members are provided in the air flow passage so as to increase a surface area of the air flow passage. In this case, the plate members are alternately extended from side walls of the air flow passage to constitute an air flow passage meandering in a horizontal direction.

Here, it is preferable that a leading end portion of each plate member is slanted toward the gravitational direction. Further, the plate members are provided in the air flow passage which extends in the counter-gravitational direction.

Preferably, each bottom portion of the air flow passage meandering in the vertical direction has a guide port communicated with the ink collecting space for guiding waste ink thereto.

Preferably, an air filter is disposed in a part of the air flow passage. Here, it is preferable that the air filter is disposed in the vicinity of the ventilation fan.

Preferably, the unit box includes: a side wall; a peripheral wall, which extends perpendicularly from the side wall to define a box body in which a side opposing to the side wall is opened; internal walls, which define the air flow passage; and a sealing member, which closes the opened side of the box body.

Here, it is preferable that a thermally fusible member is provided as the sealing member.

In the ink jet recording apparatus provided with the ink collecting unit (unit box) as described above, the ink drops ejected from the nozzle orifices of the recording head positioned in the flushing region or the ink drops ejected from the nozzle orifices of the recording head positioned in the ejecting region of the ejecting condition detector are immediately introduced into the ink collecting unit through the aperture of the ink collecting unit.

Further, the ink drops ejected from the nozzle orifices of the recording head are collected in the collecting space formed in the vicinity of the aperture of the unit box in the gravitational direction. Then the waste ink collected in the collecting space is discharged outside through the discharging port formed in the bottom portion of the collecting space.

On the other hand, even though some of the ink drops are changed into mist while such ink drops are flying after being ejected into the aperture in the unit box, the mist is surely taken into the unit box in the air flow passage of the unit box or by the air flow produced by the ventilation fan disposed in the termination end portion thereof.

The mist taken into the unit box is carried on the air flow produced by the ventilation fan and passed through the continuous air flow passage meandering in the gravitational and counter gravitational directions while being captured by contact with the inner wall face of the air flow passage.

In this case, since the contact area of the ink mist can substantially be increased by the plate members disposed in the air flow passage, the collection of the ink mist can also be increased.

Moreover, the alternate provision of the plate-like bodies in the air flow passage permits the air flow passage to be formed in a manner horizontally meandering, whereby the path of the moving air flow becomes more complicated, thus improving the collection further.

In the ejecting condition detector having the ink collecting unit for collecting the ink drops, it is preferable that a plurality of ink shading walls, each having a light transmission hole, are disposed between the light emitting module and the light receiving module. With this arrangement, the ink ejected from the nozzle forming face of the recording head is shaded by the ink shading walls.

Here, it is preferable that a plurality of partition walls are disposed between a pair of ink shading walls which define the ink ejecting region. With this arrangement, a duct for distributing ink is formed by the partition walls and the ink shading walls and the ink drops flow down in the duct.

Further, it is preferable that a cutout portion is formed on a head-side edge portion of each partition wall to form an air flow in the vicinity of the light transmission hole. With this arrangement, the ink drops ejected from the nozzle forming face of the recording head are carried on the air flow in the vicinity of the light transmission hole and passed through the cutout and flow into the ejecting region.

Still further, each partition wall is formed with an ink guide for guiding ink from the outside of the ink ejecting region to the inside of the ink ejecting region. With this arrangement, ink drops outside the ejecting region are guided into the ejecting region along the ink guide.

Preferably, an ink discharging port is formed in each internal space defined by the respective ink shading walls for discharging ink therefrom. With the arrangement, when the ink drops ejected from the nozzle forming face of the recording head flow into the internal space of the ejecting condition detector at the time of detecting the ejecting condition, the ink drops are discharged outside from the internal space via the ink discharging port.

Therefore, both modules are prevented from being contaminated by ink mist as the ink mist does not float in the ejecting condition detector and reliability from the standpoint of the detection of the ejecting condition is enhanced.

Here, the internal space is placed in the vicinity of the light emitting module. With this arrangement, when ink mist flows from the light transmission hole into the internal space near the light emitting module, the ink mist is discharged outside from the internal space via the ink discharge port.

Preferably, a size of the light transmission hole situated downwards is smaller than a size of the light transmission hole situated upwards. With this arrangement, the inflow of the ink drops ejected from the nozzle forming face of the recording head into the light transmission holes is gradually suppressed along the gravitational direction.

Preferably, a recessed portion is formed on a head-side edge portion of each ink shading wall. With this arrangement, when the ink drops ejected from the recording head flow into the recessed portion and drop, the flowing of the ink drops into the light transmission hole in the vicinity of both modules is blocked.

In order to accomplish the third object, according to the invention, there is provided an ink jet recording apparatus, comprising:

a carriage, which moves in a widthwise direction of recording paper;

an ink jet recording head, mounted on the carriage and provided with a nozzle forming face on which nozzle orifices are formed;

a head driver, which drives the recording head so as to eject ink drops from the nozzle orifices to form an image on the recording paper;

a scanning driver, which moves the recording head in a main scanning direction;

an ejecting condition detector, which performs an inspection in which it is detected whether ink drops are ejected from the nozzle orifices;

a cleaner, which performs a cleaning operation in which negative pressure is applied to the nozzle orifices to discharge ink therefrom and the nozzle forming face is wiped with a wiper; and a controller, which supplies a flushing drive signal to the head driver to eject ink drops from the nozzle orifices, after the cleaner performs the cleaning operation and before the ejecting condition detector performs the inspection.

Preferably, when an unoperating nozzle is detected as a result of the inspection, the cleaner performs the cleaning operation, the controller then supplies the flushing signal to the recording head, and the ejecting condition detector then performs the inspection.

Preferably, the recording apparatus further comprises an ink collecting unit which faces to the ejecting condition detector and includes a unit box formed with an aperture through which ink drops ejected from the recording head to which the flushing drive signal is supplied, an air flow passage formed in the unit box, and a ventilation fan disposed on the way of the air flow passage or a termination end portion of the air flow passage.

Preferably, the controller supplies the flushing drive signal after the ejecting condition detector performs the inspection.

Preferably, the controller displays an error indication when a predetermined number of inspections are repeated by the ejecting condition detector. Here, the error indication is displayed on the recording apparatus or a host computer to which the recording apparatus is connected.

In order to accomplish the third object, according to the invention, there is also provided an inspection method used in a recording apparatus, comprising: a carriage, which moves in a widthwise direction of recording paper, an ink jet recording head, mounted on the carriage and provided with a nozzle forming face on which nozzle orifices are formed; a head driver, which drives the recording head so as to eject ink drops from the nozzle orifices to form an image on the recording paper, and a scanning driver, which moves the recording head in a main scanning direction, the method comprising the steps of:

performing a cleaning operation in which negative pressure is applied to the nozzle orifices to discharge ink therefrom and the nozzle forming face is wiped with a wiper;

supplying a flushing drive signal to the head driver to eject ink drops from the nozzle orifices, after the cleaning operation is performed; and performing an inspection in which it is detected whether ink drops are ejected from the nozzle orifices, after the flushing operation is performed.

Preferably, the inspection method further comprises the steps of:

performing the cleaning operation when an unoperating nozzle is detected as a result of the inspection;

supplying the flushing drive signal to the head driver after the cleaning operation is performed; and performing the inspection after the flushing operation is performed.

Preferably, the inspection method further comprises the step of supplying the flushing drive signal after the inspection is performed.

Preferably, the inspection method further comprises the step of displaying an error indication when a predetermined number of the inspections are repeated. Here, the error indication is displayed on the recording apparatus or a host computer to which the recording apparatus is connected.

Therefore, any unstable nozzle orifice, if any, can be shifted to either a inferior condition (unoperating condition) in which ink is not ejected completely during flushing or a condition in which ink is satisfactorily ejected. Consequently, the condition of the nozzle orifice is never changed after the inspection is made to ensure that the presence or absence of ink ejection is detected by the inspection. Non-conforming printing action is never caused thereafter.

When an unoperating nozzle is detected as a result of the inspection, since the cleaner performs the cleaning operation, the controller then supplies the flushing signal to the recording head, and the ejecting condition detector then performs the inspection again, the nozzle orifices can completely be restored to the normal condition, so that improved-quality printing can be attained.

Since the ink collecting unit is provided so as to face to the ejecting condition detector, the ink drops ejected from the nozzle orifices of the recording head positioned in the ejecting region of the ejecting condition detector are immediately introduced into the ink collecting unit through the aperture of the ink collecting unit. Even though some of the ink drops are changed into mist while such ink drops are flying after being ejected into the aperture in the unit box, the mist is surely taken and collected into the unit box in the air flow passage of the unit box or by the air flow produced by the ventilation fan disposed in the termination end portion thereof.

Ink viscosity may be prevented from increasing by supplying the flushing drive signal to the head driver to eject ink after the termination of inspection.

Moreover, an error may be displayed to warn the user that maintenance is needed in case where a predetermined number of inspections are repeated by the ejecting condition detector.

BEST MODE FOR CARRYING OUT THE INVENTION

Figure 1:
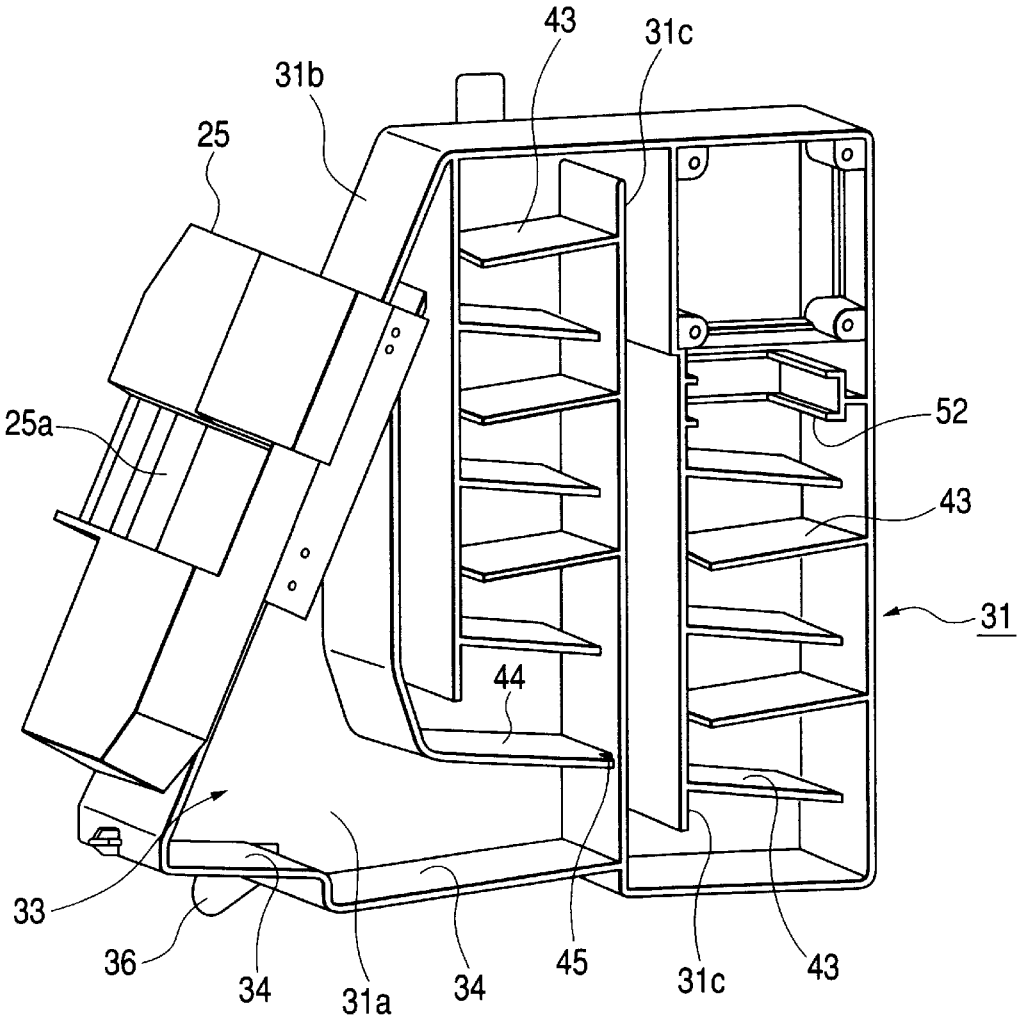
FIG. 1 is a perspective view showing the overall construction of a unit box in an ink collecting unit installed in an ink jet recording apparatus according to an embodiment of the invention.

An ink jet recording apparatus will now be described by reference to an embodiment of the invention shown in the drawings. FIGS. 1 to 4 show an ink collecting unit installed in an ink jet recording apparatus according to the invention. FIG. 1 is a perspective view of the whole unit box forming the ink. collecting unit.

Figure 2:
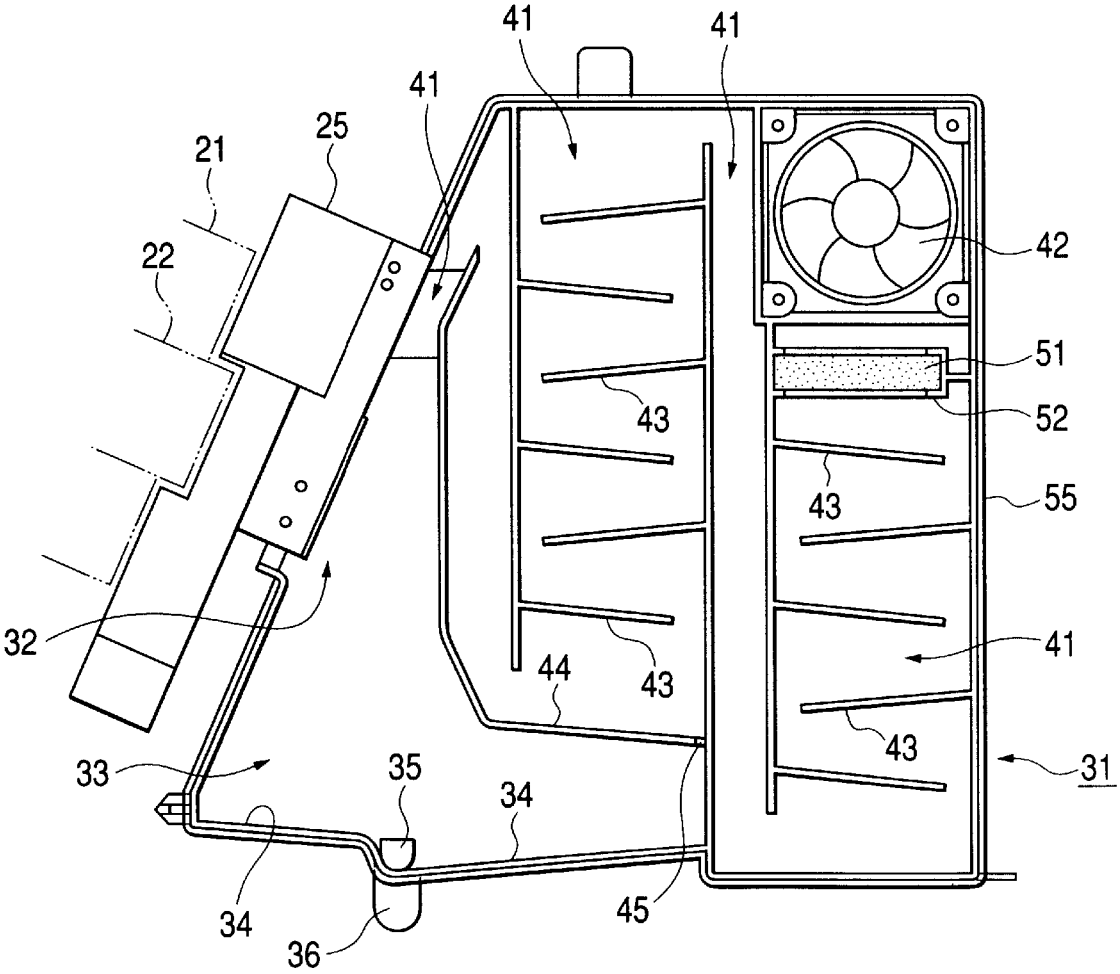
FIG. 2 is an elevational view of the ink collecting unit with a ventilation fan mounted in the unit box shown in FIG. 1.
Figure 3:
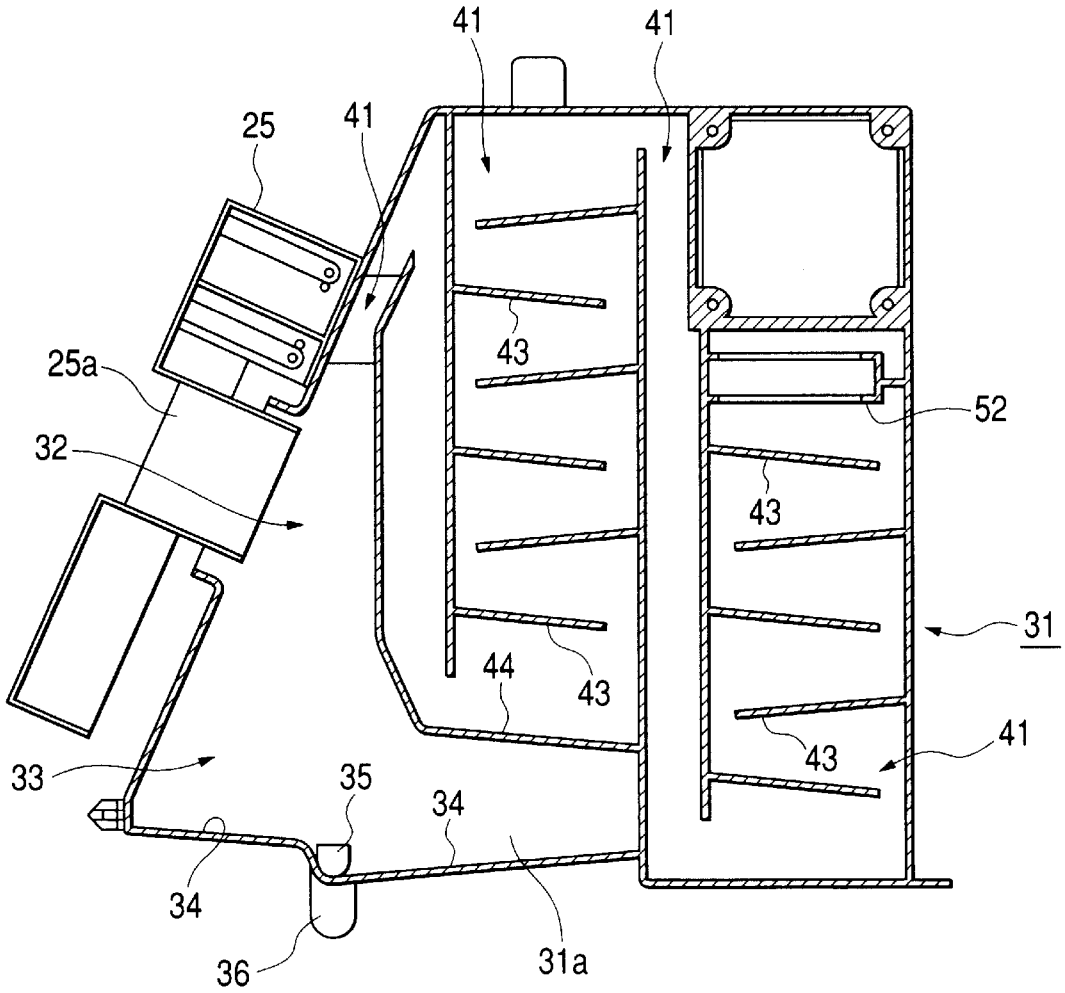
FIG. 3 is a vertical sectional view of the unit box shown in FIG. 1 with the unit box being cut along a vertical plane.
Figure 4B:
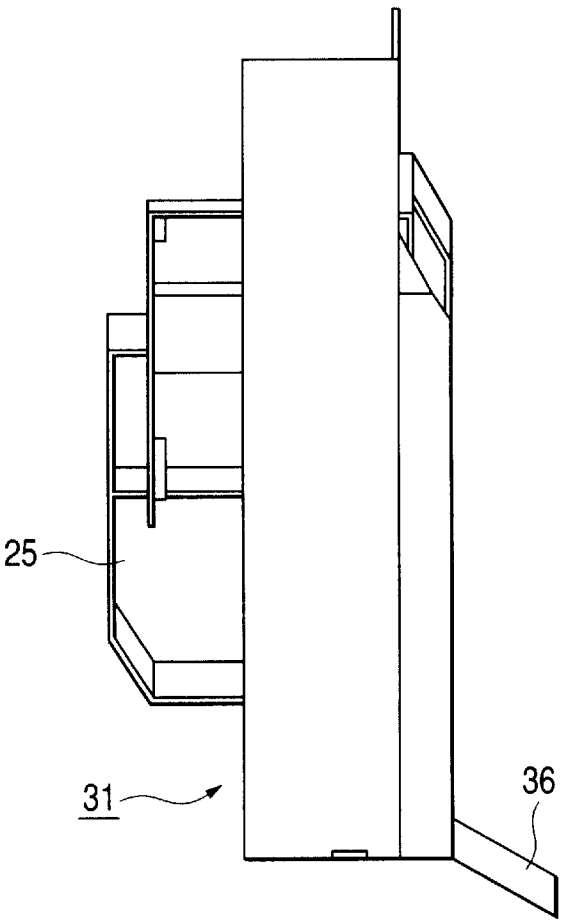
FIG. 4 shows side views of the ink collecting unit as viewed from the left and right sides.
Figure 4A:
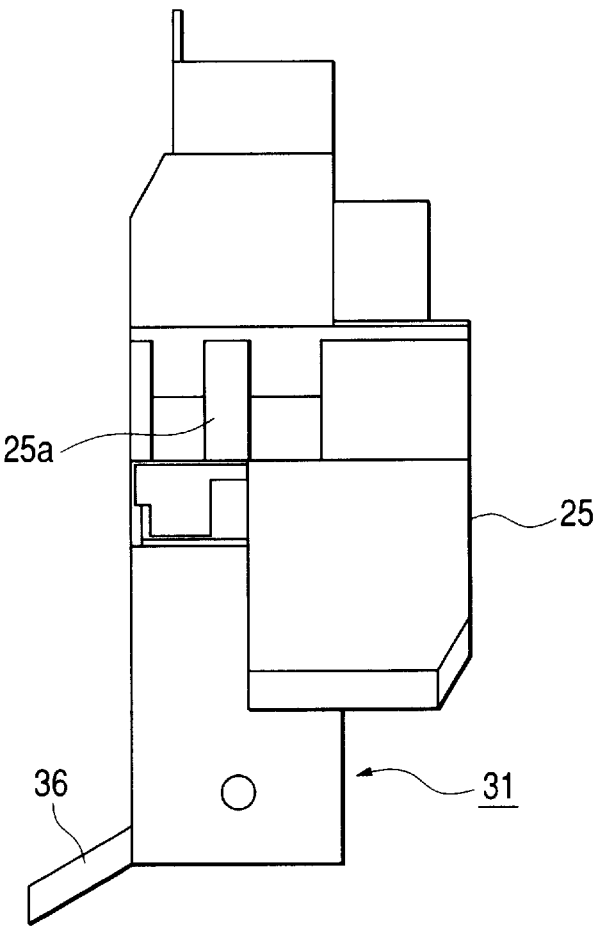

Further, FIG. 2 is an elevational view of the ink collecting unit; FIG. 3, a sectional view of the unit box that is cut along a vertical plane; and FIGS. 4A and 4B, side views of the ink collecting unit as viewed from the left and right sides.

The ink collecting unit is employed in such a recording apparatus that a nozzle forming face of an ink jet recording head 22 mounted on a carriage 21 is directed obliquely downward as shown in FIG. 2, for example. More specifically, the carriage 21 and the recording head 22 mounted thereon in FIG. 2 is reciprocated in the perpendicular direction of this drawing so that the recording head 22 can perform a scan of recording paper (not shown) in its width direction, the recording paper being fed in the oblique direction.

The ink collecting unit is disposed in part of the moving path of the recording head 22 and collects ink drops idly ejected from the recording head 22 based on a flushing operation.

An acceptance aperture 32 through which the ink drops ejected from the nozzle orifices of the recording head 22 due to the flushing operation is formed in a unit box 31 forming the ink collecting unit as shown in FIGS. 2 and 3. In this embodiment, another component member 25 irrelevant to the ink collecting unit is disposed between the acceptance aperture 32 formed in the unit box 21 and the scanning area of the carriage 21 in such a condition as fitted in the unit box 31.

The ink drops based on the flushing operation are ejected toward the acceptance aperture 32 via a duct-like opening 25*a* (see FIG. 3) formed in the component member 25.

A collecting space 33 is extended in the gravitational direction, that is, downward just behind the acceptance aperture 32 within the unit box 31. Consequently, most of the ink drops ejected from the recording head 22 based on the flushing operation drop into the collecting space 33 and temporarily stored in its bottom portion 34. Further, the bottom portion 34 of the collecting space 33 has two slant faces lowered toward its substantially central portion and a waste fluid discharge port 35 is formed in the lowest position between these two slant faces.

Therefore, most of the ink drops ejected due to the flushing operation go down on the slant faces formed in the bottom portion 34 of the collecting space 33 and are guided to the discharge port 35 so that the ink drops thus ejected can be discharged from the discharge port 35 via a disposal pipe 36 projected outside.

On the other hand, an air flow passage 41 is formed in the counter-gravitational direction, that is, upward just behind the acceptance aperture 32 within the unit box 31. This air flow passage 41 is formed in a manner meandering and vertically folded back as shown in FIGS. 1 to 3. A ventilation fan 42 is disposed in the upper end portion of the unit box forming the termination end portion of the air flow passage 41 as shown in FIG. 2. Incidentally, the air flow passage 41 may be formed in a manner meandering and laterally folded back instead of meandering and vertically folded back.

With this arrangement, an air flow is formed from the acceptance aperture 32 of the unit box via the air flow passage 41 toward the termination end portion of the air flow passage when the ventilation fan 42 is driven. In this case, an air flow rate in the acceptance aperture 32, that is, a suction flow rate is preferably regulated so that it is approximately 1 m/sec or higher.

With this arrangement, in case where some of the ink drops ejected from the recording head due to the flushing operation are changed into ink mist while they are flying, the ink mist is guided into the continuous air flow passage vertically meandering as it accompanies the air flow.

In the continuous air flow passage 41 according to this embodiment, the width of the air flow passage directed in the counter-gravitational direction (upward) is set greater and plate bodies 43 alternately disposed are formed in the wide air flow passage.

Each of the plate bodies 43 serves as what practically increases the surface area of the air flow passage and as the plate bodies 43 are disposed alternately, the air flow passage 41 is formed so that it meanders in the horizontal direction.

Consequently, the ink mist vertically meanders to the accompaniment of the air flow and passes through the air flow passage 41 laterally meandering, whereby the ink mist is captured by the wall face of the air flow passage 41 or by contact with each of the plate bodies 43.

Then as shown in FIGS. 1 to 3, each of the plate bodies 43 is formed so that its front end portion is slightly inclined in the gravitational direction. With this arrangement, waste fluid originating from the ink mist captured by the plate bodies is made to flow on the face of each plate body before being dropped and thus the collection of water fluid is promoted.

In this embodiment as shown in FIGS. 1 and 2, a guide hole 45 communicating with the collecting space 33 is formed in a bottom portion 44 of the air flow passage where the plate bodies 43 are disposed first in the air flow passage directed from the acceptance aperture 32 to the termination end portion.

The bottom portion 44 in the air flow passage is made a slant face lowered in one direction and the guide hole 45 is formed in the lowest position of the slant face.

Therefore, the waste fluid brought into contact with and captured by each of the plate bodies 43 drops onto the bottom portion 44 in the air flow passage and goes down along the slant face formed in the bottom portion 44 and is then introduced into the collecting space 33 via the guide hole 45. Thus, the waste fluid introduced into the collecting space 33 is guided to the discharge port 35 before being discharged via the disposal pipe 36 from the discharge port 35.

In this embodiment, the guide hole 45 as described above is not formed in the bottom portion of the air flow passage as it is positioned close to the termination end portion of the air flow passage wherein the plate bodies 43 are disposed. The reason for this is that waste fluid is not sufficiently accumulated in that bottom portion that is positioned close to the termination end portion of the air flow passage and this makes the concentration of the ink mist extremely low. However, as waste fluid may be accumulated even in a position close to the termination end portion of the air flow passage depending on the way the air flow passage and the like are designed, it is desirable to make waste fluid dischargeable by forming such a guide hole 45 in the bottom portion likewise.

On the other hand, an air filter 51 is disposed immediately in front of the ventilation fan 42 disposed in the termination end portion of the air flow passage as shown in FIG. 2. The air filter 51 is rectangular and flat in shape and fitted in a space portion formed by a rib 52 along the outer shape thereof. Therefore, the minute ink mist not captured by the continuous air flow passage can be captured by this air filter 51.

As is understood from the overall construction shown in FIG. 1, the unit box 31 forming the ink collecting unit is a box-like member with one side wall 31*a* and a peripheral side wall 31*b* coupled thereto being integrally formed and with the other side facing the one side wall 31*a* being opened. Further, an inner wall body 31*c* for forming the continuous air flow passage and the like is integrally formed with the inner portion surrounded by the peripheral side wall 31*b* with the one side wall 31*a*.

With this arrangement, the one side wall 31*a*, the peripheral side wall 31*b* and the inner wall body 31*c* can be molded integrally by injection molding, for example, the unit box 31 is formable by sealing the open end portion of the box-like member integrally molded with a flat-plate-like sealing member.

In this embodiment, a thermally fusible film 55 formed of a transparent resin material is used as the sealing member as shown in FIG. 2. In other words, the thermally fusible film 55 is pre-cut so that the film substantially coincide with the external shape of the peripheral side wall 31*b* integrally molded into the one side wall 31*a*.

Then the thermally fusible film 55 is mounted along the open end portion of the peripheral side wall 31*b* before a heater chip (not shown) is brought into contact therewith from above, whereby the thermally fusible film 55 is welded to each of the open end portions of the peripheral side wall 31*b* and the inner wall body 31*c* to obtain the unit box 31.

A plate-like sealing member in place of the thermally fusible film 55 may be used. In this case, the plate-like sealing member is first formed of thermoplastic synthetic resin, for example, and then the sealing member can be welded to each of the open end portions of the peripheral side wall 31*b* and the inner wall body 31*c*.

Although the ventilation fan 42 is disposed in the termination end portion of the air flow passage formed in the unit box in the above-described embodiment, the same advantageous effect is obtainable in case where the ventilation fan 42 is disposed within the air flow passage formed in the unit box. Moreover, though the air filter is disposed immediately in front of the ventilation fan, the same advantageous effect is also achievable in case where the air filter is disposed in any place within the air flow passage formed in the unit box.

As is obvious from the description given above, the acceptance aperture through which the ink drops ejected from the nozzle orifices of the recording head because of the flushing operation, and the continuous air flow passage in the manner vertically folded back in the gravitational and counter-gravitational directions are formed in the unit box forming the ink collecting unit of the ink jet recording apparatus according to the invention. As the air flow directed. from the acceptance aperture to the termination end portion of the air flow passage is formed by the ventilation fan, even though the ink drops ejected from the nozzle orifices are changed into ink mist, it is ensured that the ink mist can be captured in the unit box. As the ink mist is captured in the continuous air flow passage formed in the manner vertically folded back, the problem of causing the inside and outside of the apparatus to be contaminated by the ink mist becomes solvable.

An ink jet recording apparatus having the above-described ink collecting unit and capable of effectively collecting the ink mist produced when the ejecting condition is detected will now be described with reference to FIGS. 6 to 12. As the ink collecting unit in this case is basically similar in construction to what is shown in FIGS. 1 to 4, like reference numerals are given to like component parts with the omission of detailed description thereof.

Figure 6:
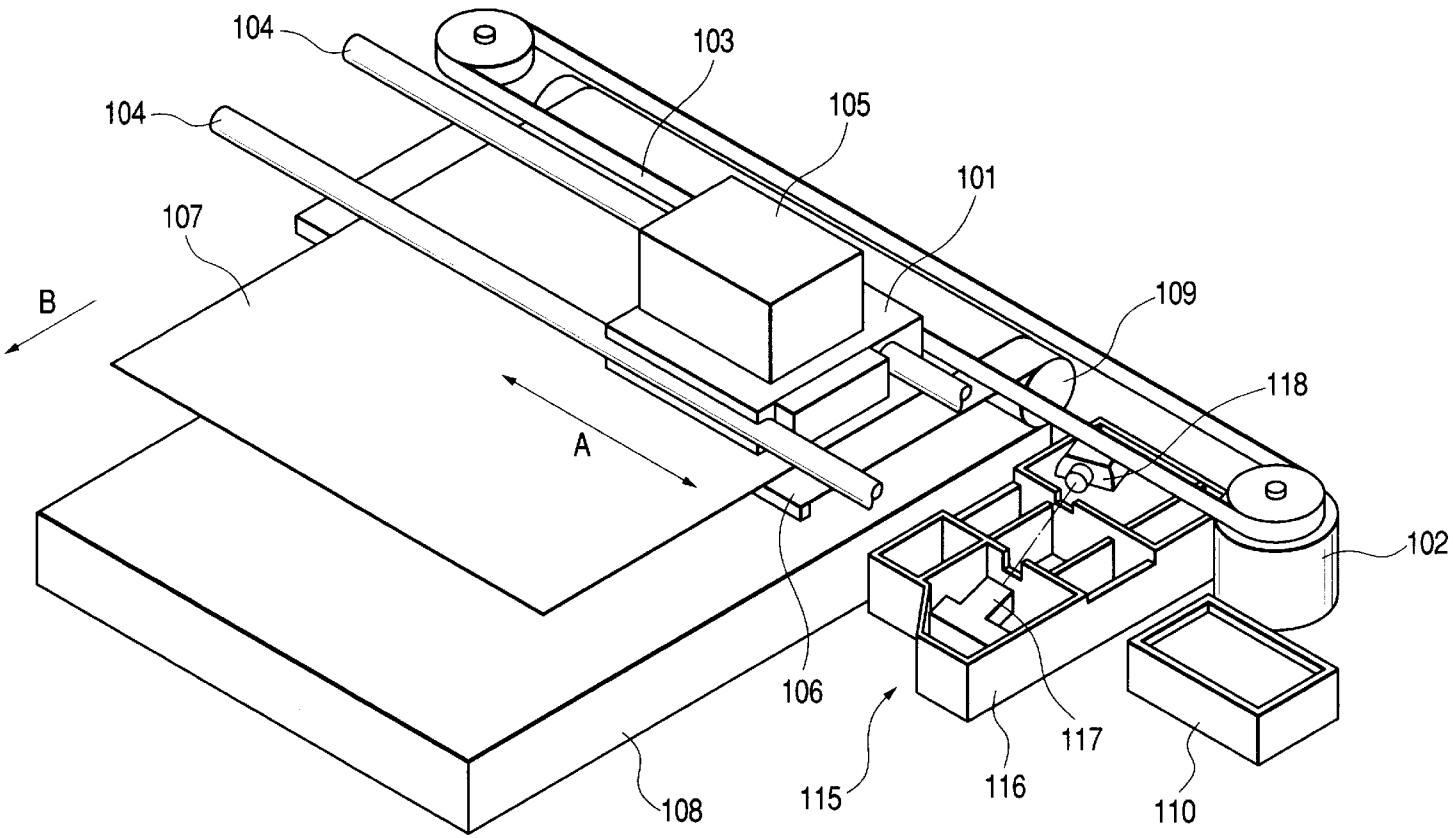
FIG. 6 is a schematic perspective view showing the construction of an ink jet recording apparatus according to a second embodiment of the invention.

FIG. 6 is a perspective view of the basic arrangement of the recording apparatus proper.

As shown in FIG. 61 a carriage 101 is coupled to part of a timing belt 103 driven by a carriage motor 102 and capable of reciprocation in the horizontal scanning direction (direction shown by an arrow A) while being guided by two guide members 104 disposed in parallel to each other.

An ink jet recording head 105 is mounted on the carriage 101, and a platen 106 is disposed under the carriage along the scanning direction of the recording head 105 accompanied by the movement of the carriage.

Further, recording paper 170 is wound by a paper feeding roller 109 from a paper stacker 108 and conveyed on the platen 106. In other words, the recording paper 107 is successively conveyed in the vertical scanning direction as shown by an arrow B.

Thus, printing is performed on the recording paper 107 conveyed along the platen 106 when ink drops are ejected from the recording head 105.

Reference numeral 110 in the drawings denotes a head cap that is disposed in a non-printing region (home position). The head cap 110 is moved upward when the recording head 105 mounted on the carriage 101 moves right upward so as to seal a nozzle forming face of the recording head 105.

A portion of the head cap 110 used to seal the nozzle forming face is formed of elastic material such as elastomeric material or the like and serves as a cover body for preventing the nozzle orifices of the recording head 105 from being dried out during the suspension of operation of the recording apparatus.

In addition, the head cap 110 also serves as a cleaner for causing the capability of ejecting ink drops to be collected by causing ink to be sucked and discharged from nozzle orifices of the recording head 105 on receiving the negative pressure from a suction pump (not shown).

On the other hand, an ejecting condition inspector (ejecting condition detector) 115 for inspecting (detecting) the condition of the ink drops ejected from each of the nozzle orifices of the recording head 105 is disposed in the vicinity (downward) of the moving path of the recording head 105 on the side of the printing region adjacent to the head cap 110.

As will be described in detail below, the ejecting condition detector 115 is disposed in a casing 116 forming a base member and forms an optical unit having a light emitting module 117 for emitting converged light and a light receiving module 118 for receiving the converged light from the light emitting module 117.

The ejecting condition detector 115 is arranged so that the converged light is emitted in a manner crossing the flying courses of the ink drops ejected from the nozzle orifices of the recording head 105. While controlling the ejection of ink drops from the nozzle orifices of the recording head 105 in time series, the ejecting condition detector 115 detects the quantity of light in the light receiving module 118 whereby to specify the unsatisfactory ejecting condition of ink drops in each of the nozzle orifices, that is, dot omission.

Figure 5:
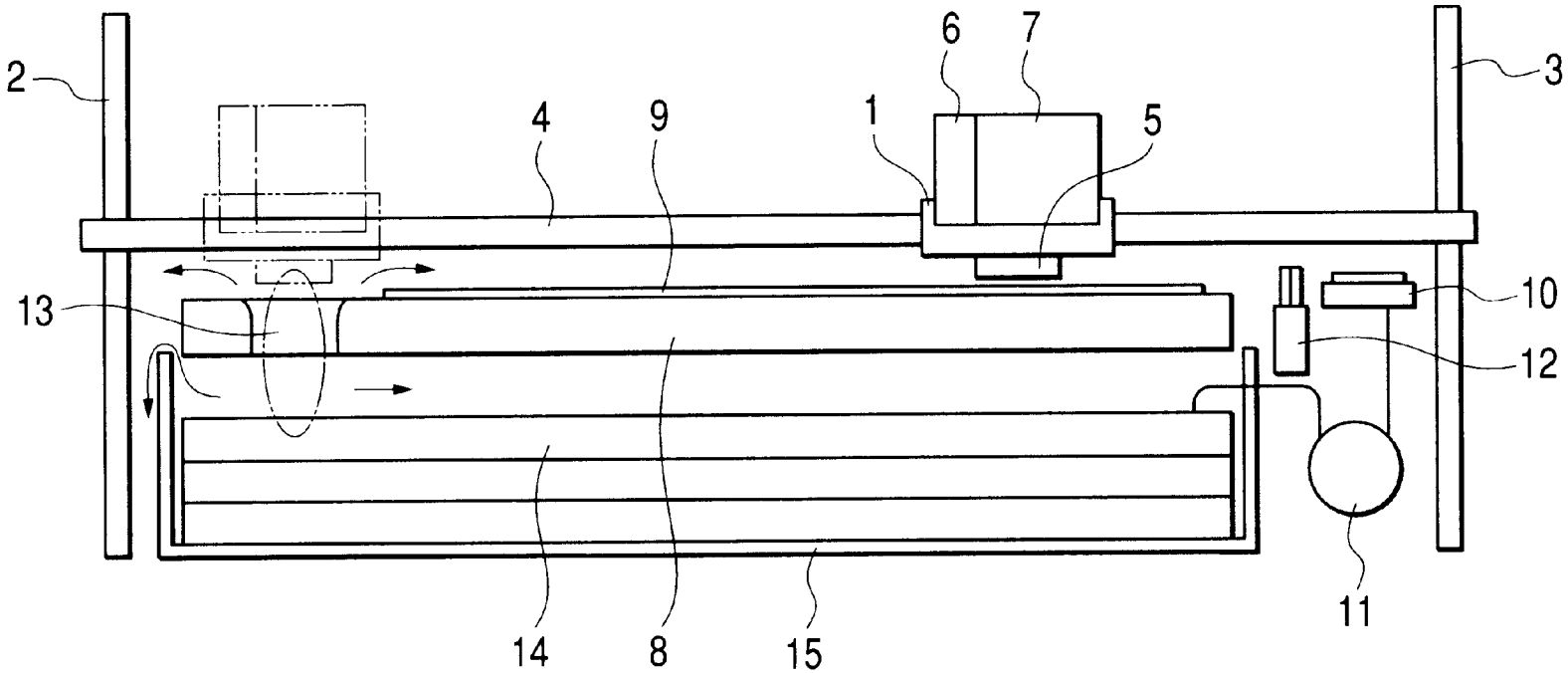
FIG. 5 is a vertical sectional view of an example of a flushing region in a conventional ink jet recording apparatus.
Figure 7:
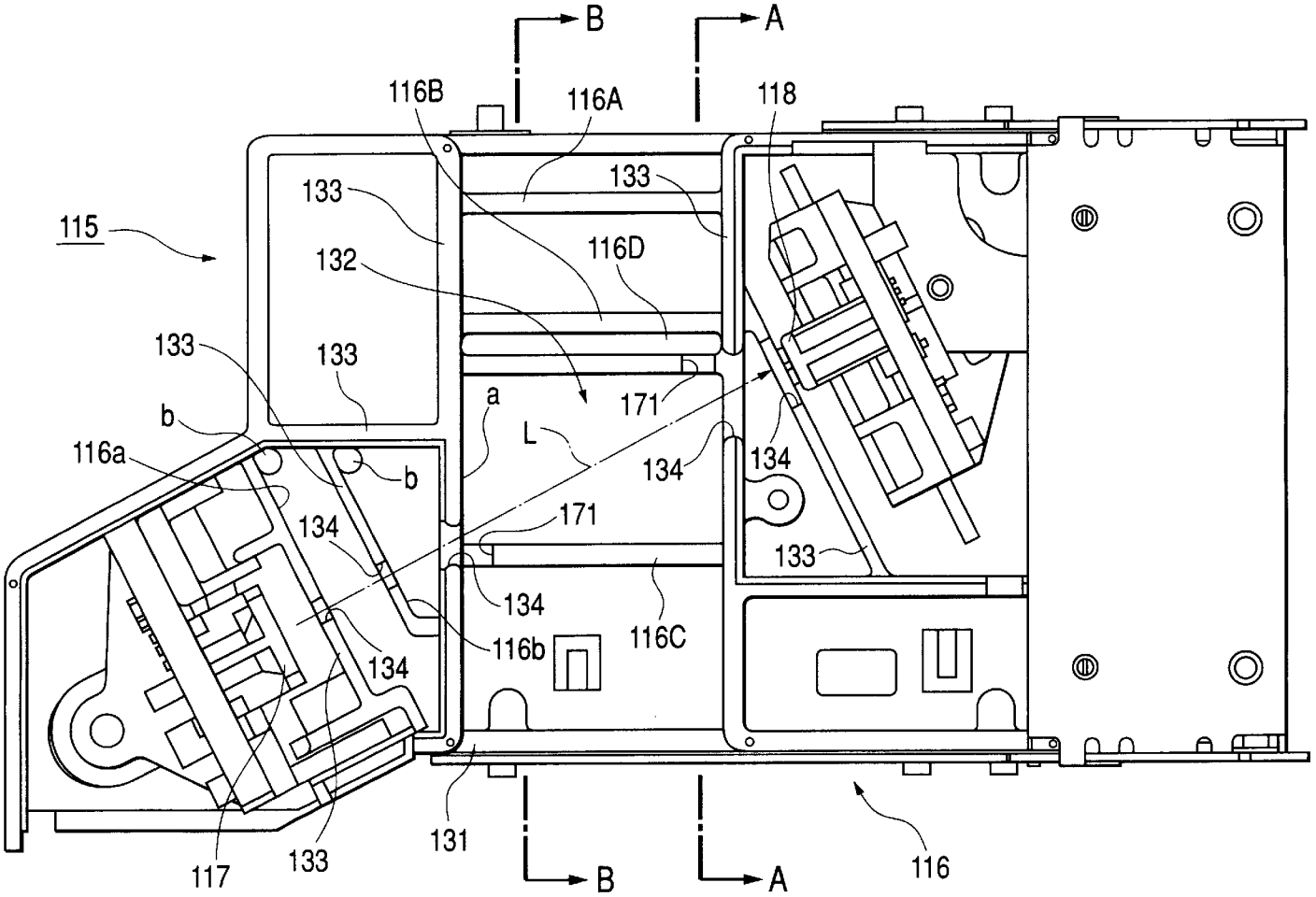
FIG. 7 is a plan view of an optical unit as viewed from above, forming a dot-omission detector of the ink jet recording apparatus shown in FIG. 6.
Figure 8:
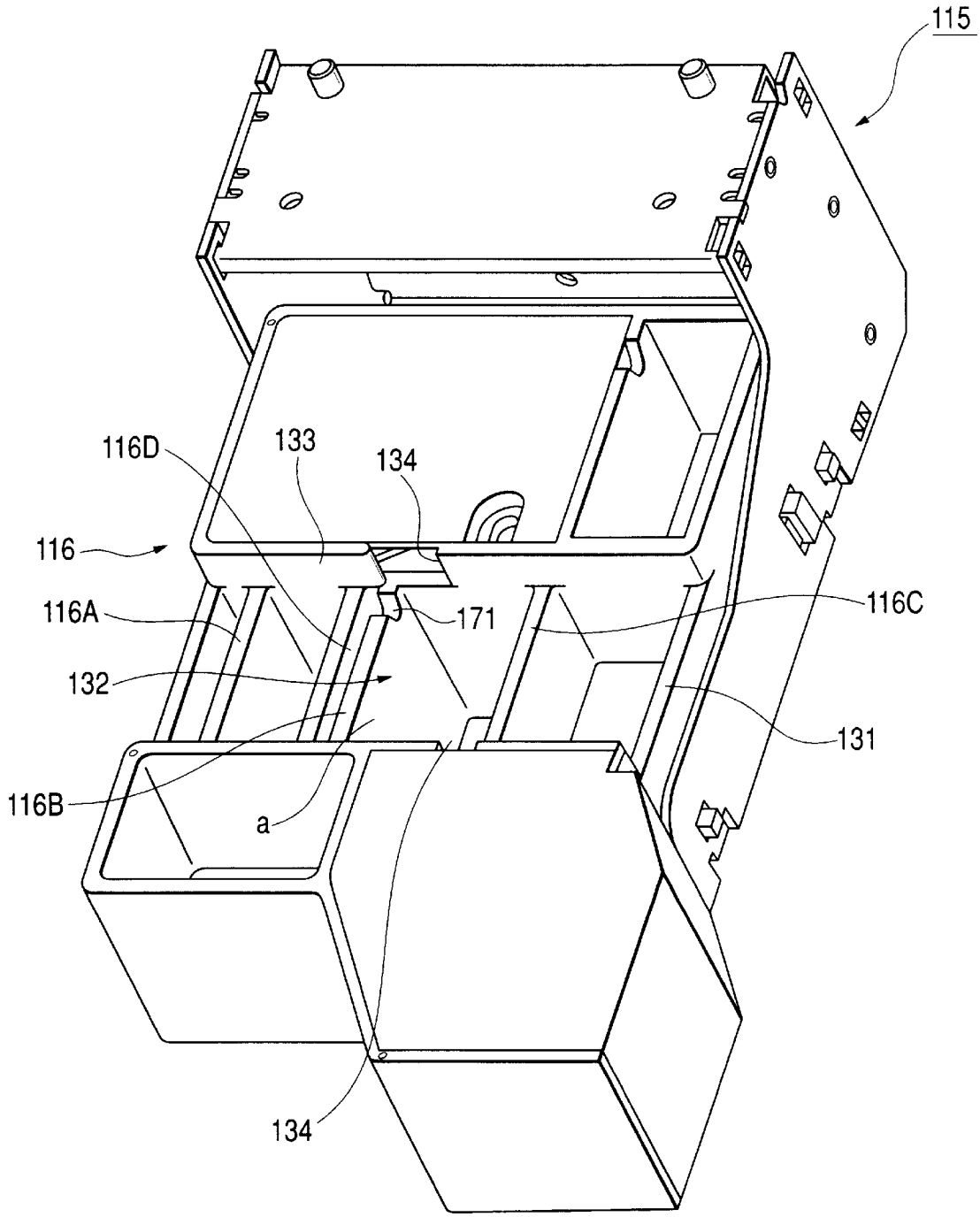
FIG. 8 is a perspective view of the optical unit as obliquely viewed from above, for the dot-omission detector.
Figure 9A:
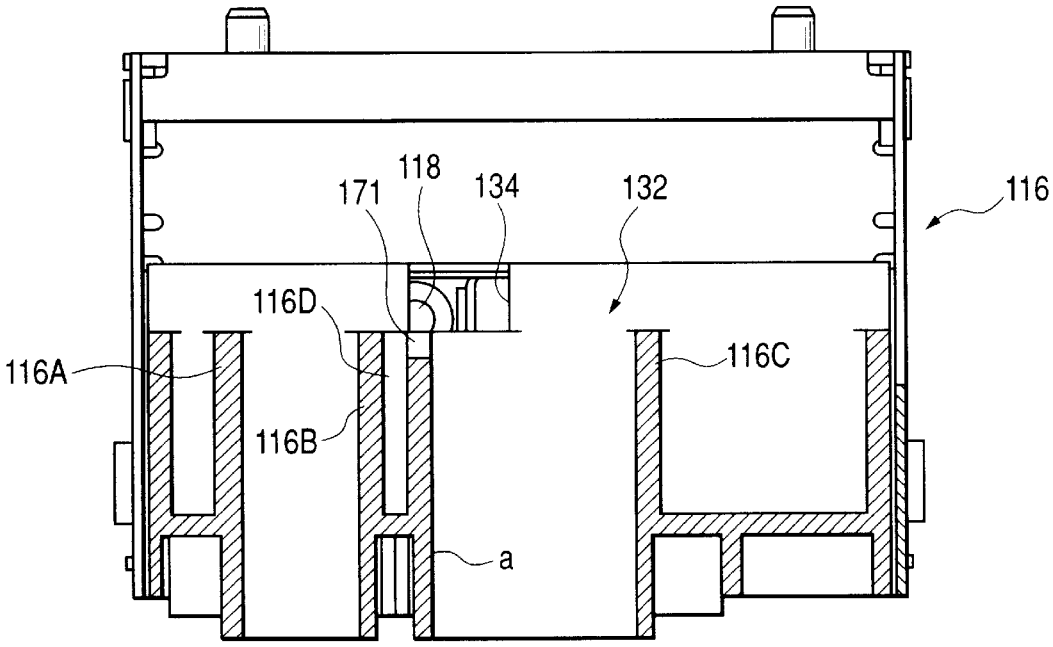
FIGS. 9A and 9B are sectional views of the dot-mission detector taken on lines A—A and B—B of FIG. 7 as viewed from the directions of arrows, respectively.
Figure 9B:
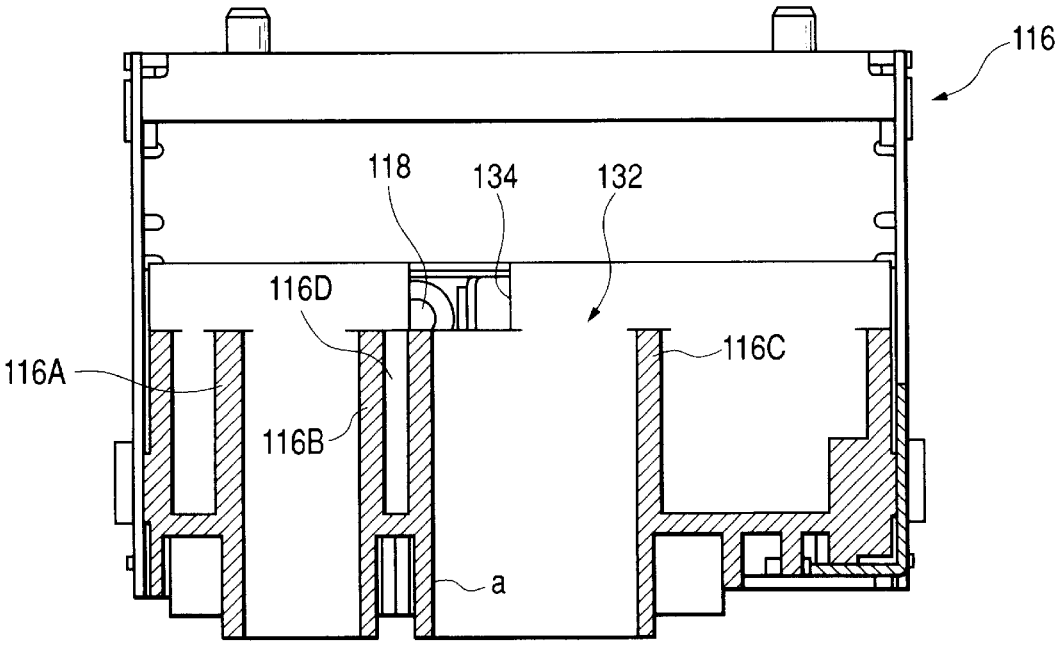

FIGS. 7 to 9 shows the construction of the ejecting condition detector (hereinafter also called a dot omission detector) equipped with the optical system. FIG. 7 is a plan view of a dot omission detector and FIG. 8 is a perspective view of a light receiving and a light emitting module covered with a cover body in the dot omission detector. FIGS. 9A and 9B are sectional views of the dot-omission detector portion taken on lines A—A and B—B of FIG. 7 as viewed from the directions of arrows, respectively. In FIGS. 4 to 6, the same reference numerals are given to similar components that have already been described.

The casing 116 forming the base member of the dot omission detector 115 is formed with a box body made of hard synthetic resin, in which a top portion is opened. A recessed portion 131 is provided in the casing 116 in a manner substantially crossing the central portion of the casing as shown in FIGS. 7 and 8. Further, the recording head 105 mounted on the carriage 101 is arranged so as to pass through the recessed portion 131 in the direction along the drawing (FIG. 7). Moreover, the light emitting module 117 and the light receiving module 118 are disposed in both the respective positions with the recessed portion 131 held therebetween.

An ejecting region 132 is provided in the substantially central portion of the recessed portion 131 through which laser light L passes from the light emitting module 117 up to the light receiving module 118. The base portion of the ejecting region 132 is opened and this opening portion is formed such that an ink collecting unit having a ventilation fan is connected thereto as will be described below, whereby the ink drops ejected toward the ejecting region 132 are collected by the ink collecting unit when the dot omission detection is performed.

The ink drops ejected toward the ejecting region 132 are often separated into fine drops on receiving air resistance and the like and resolved into mist (ink mist). Even the ink mist like this is sucked into the ink collecting unit (to be described later) by the ventilation fan (to be described later) before being captured within the ink collecting unit.

Further, a plurality of ink shading walls 133 are provided between the light emitting module 117 and the light receiving module 118 in the casing 116 forming the base member of the optical unit. The ink shading walls 133 serve as those for effectively preventing the contamination of the light receiving module 117 and the light receiving module 118 because of the generation of the ink mist. Moreover, two internal spaces 116*a* and 116*b* juxtaposed along the light path are provided by the ink shading wall 133 positioned close to the light emitting module 117 out of these ink shading walls 133 and the base portion of the casing 116.

A cutout portion (light transmission hole) 134 is formed in part of each of the ink shading walls 133 to secure the light path of the laser light L. The width dimensions of the light transmission holes are set as shown in FIG. 7 so that the width dimension is gradually decreased from the light transmission holes situated in the counter-gravitational position toward the light transmission holes situated in the gravitational position. More specifically, the dimension is set so that it is gradually decreased from the light transmission holes in the ejecting region 132 toward the light transmission holes in the vicinity of the light emitting module 117, whereby the inflow of the ink drops ejected from the nozzle forming face 105*a* of the recording head 105 into the light transmission holes 134 is gradually suppressed along the gravitational direction.

Therefore, since the ink mist is not caused to become afloat in the ejecting region 132 according to this embodiment, the contamination with respect to the modules 117 and 118 are prevented from being generated, so that reliability from the standpoint of the detection of the ejecting condition is enhanced.

A discharging port b for discharging ink drops in both the internal spaces 116*a* and 116*b* from the casing 116 is provided in the base portion (corner portion) of the casing 116, whereby when the ink drops (ink mist) ejected from the nozzle forming face 105*a* of the recording head 105 at the time detecting the ejecting condition flow into the internal spaces 116*a* and 116*b*, ink drops are discharged outside from the discharge port b.

Further, partition walls 116A–116C lying between the two ink shading walls for forming the ejecting region 132 out of the above-described ink shading walls 133 are integrally provided in the casing 116. With the partition walls 116B and.116C and the ink shading walls 133, a duct a for ink distribution so as to shorten the gap between the recording head 105 and the ejecting region 132 is formed, ink drops (ink mist) being thus caused to flow in the duct 1. Moreover, the casing 116 of the ejecting condition detector 115 is reinforced by the partition walls 116A–116C.

The partition wall 116B in the central portion out of the partition walls 116A–116C has a width dimension greater than those of the other partition walls 116A and 116C. A recess 116D opening to the recording head side (upper side) is provided in the partition wall 116B, whereby when the ink drops ejected (scattered) from the recording head 105 onto the head-side edge face of the partition wall 116B flow into the recess 116D and drop therebelow, the flowing of the ink drops into the light transmission hole 134 in the vicinity of both modules 117 and 118 is blocked.

A cutout 171 for forming an air flow near the light transmission holes 134 is provided in the upper end edge of each of the partition walls 116B and 116C, whereby the ink drops ejected from the nozzle forming face 105*a* of the recording head 105 are carried on the air flow in the vicinity of each light transmission hole 134 and then passed through each cutout 171 before being made to flow downward in the ejecting region (duct a). Consequently, the ink drops flowing in the vicinity of each light transmission hole 134 (cutout 171) is prevented from flowing into the light transmission hole 134 in the vicinity of both modules 117 and 118.

Figure 10:
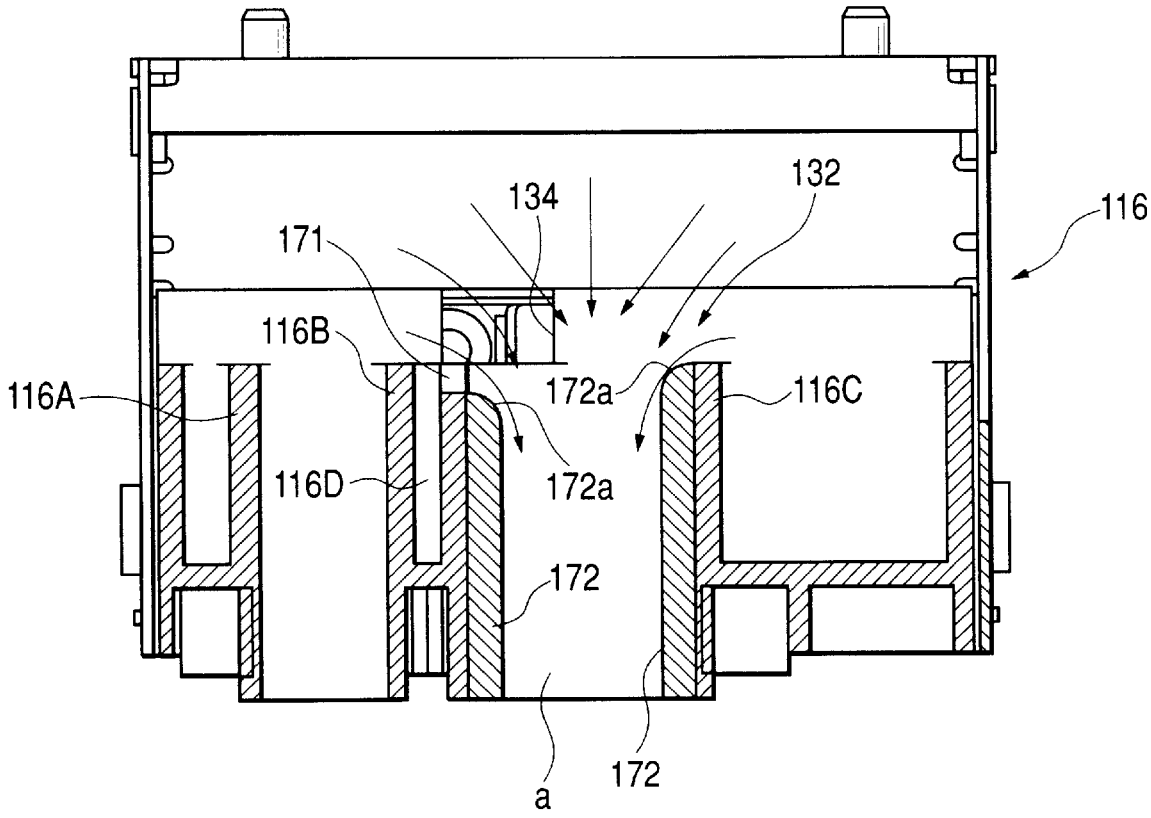
FIG. 10 is a sectional view illustrative of a modified example of FIG. 7A.

In this case, an ink guide 172 having a curved face 172*a* for guiding ink drops outside the duct a into the duct a is preferably provided on the inner face of each of the partition walls 116B and 116C out of the partition walls 116A–116C as shown in FIG. 10. Thus, ink drops outside the duct a can effectively be guided along the curved face 172*a* of the ink guide 172 into the duct a.

Figure 11:
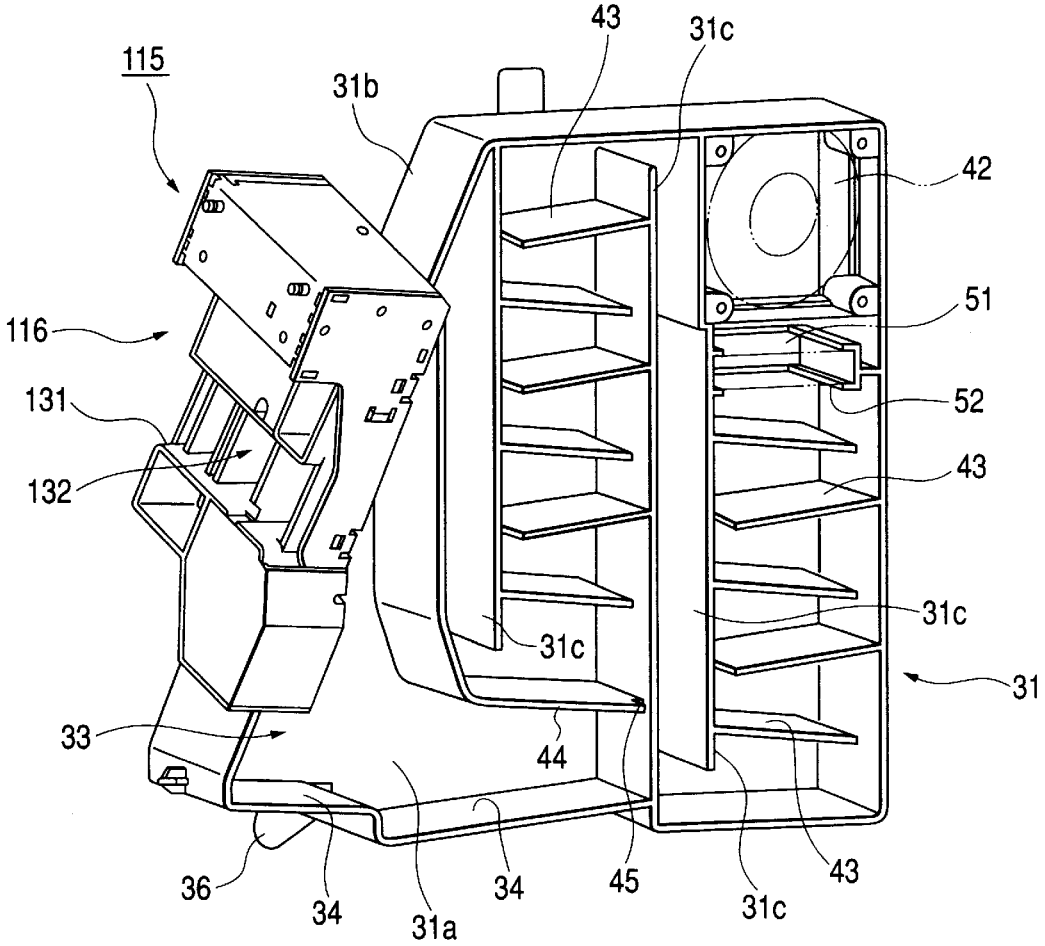
FIG. 11 is a perspective view of the dot-omission detector and the ink collecting unit showing the way both are coupled together in the ink jet recording apparatus to which the invention is applied.
Figure 12:
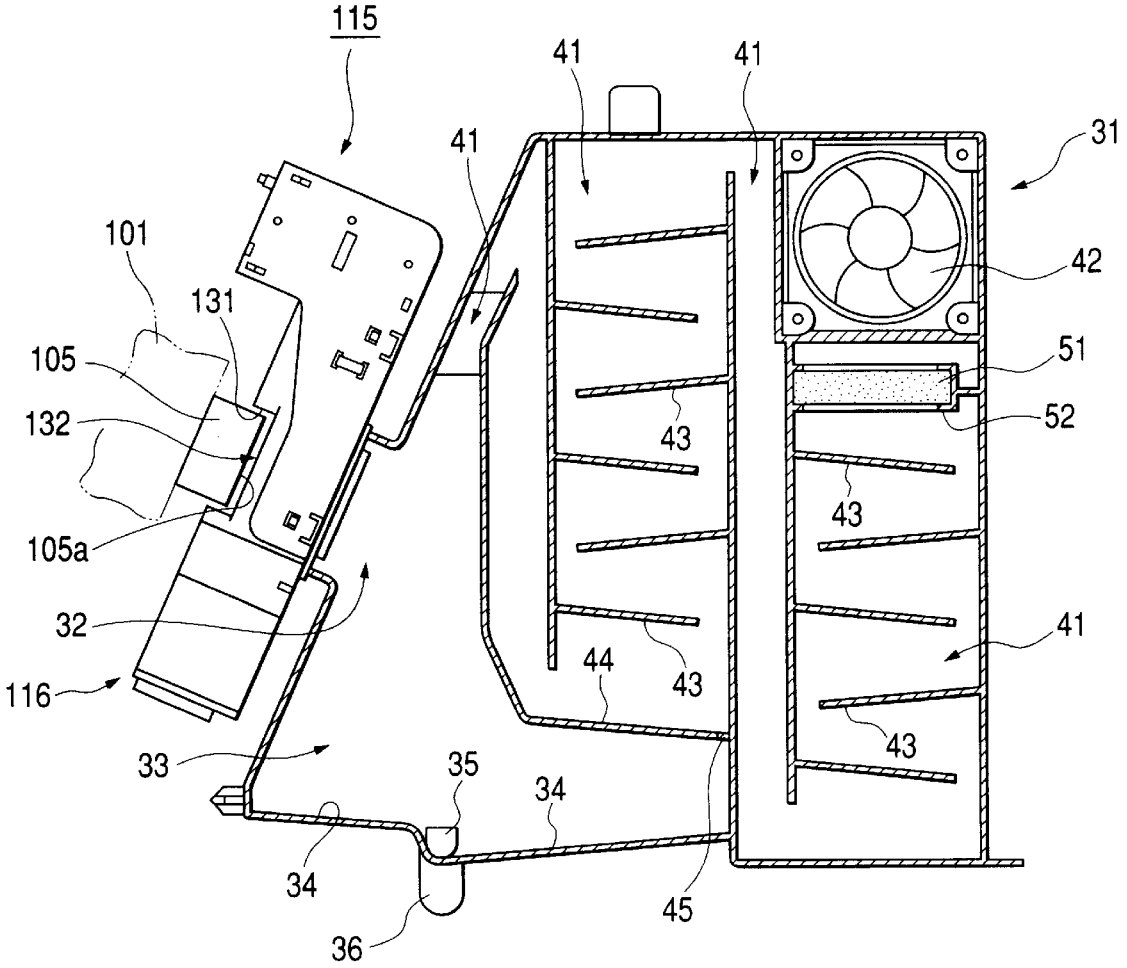
FIG. 12 is a sectional view of the dot-omission detector and the ink collecting unit showing the way both are coupled together in the ink jet recording apparatus to which the invention is applied.

FIGS. 11 and 12 are a perspective and a sectional view showing the relation between the ink collecting unit and the dot omission detector installed in the ink jet recording apparatus.

As shown in FIGS. 11 and 12, the ink collecting unit (the unit box 31) is employed for the recording apparatus in which the nozzle forming face 105*a* of the recording head 105 is disposed obliquely downward. More specifically, as shown in FIG. 12, the carriage 101 together with the recording head 105 moves reciprocately in a direction perpendicular to the drawing, so that the recording head 105 carries out a scan of recording paper (as shown in FIG. 6) in its width direction, the recording paper being fed in the oblique direction.

The ink collecting unit (the unit box 31) is disposed on the counter head moving path side of the dot omission detector 115, whereby when ink drops are ejected from the nozzle forming face 105*a* of the recording head 105, the ink drops are passed through the dot omission detector 115 before being collected into the unit box 31.

As this ink collecting unit is basically similar in construction to the ink collecting unit shown in FIGS. 1 to 4, the air flow formed simultaneously with the driving of the ventilation fan 42 is directed from the duct a to the termination end portion of the air flow passage 41 via the acceptance aperture 32 of the ink collecting unit 31 and the initial end portion of the air flow passage 41. In this case, an air flow rate in the acceptance aperture 32, that is, a suction flow rate is regulated so that it is approximately 1 m/sec or higher.

Thus, in case where some of the ink drops ejected from the recording head 105 are changed into ink mist while they are flying, the ink mist performed on the air flow produced by the ventilation fan 42 drops in the duct a. Further, the ink mist passes through the acceptance aperture 32 and flows into the air flow passage 41 in the unit box 31.

Therefore, as ink mist does not float in the ejecting region 132 according to this embodiment, both modules 117 and 118 are prevented from being contaminated by ink mist, so that reliability from the standpoint of the detection of the ejecting condition is enhanced.

A description will now be given of an ink jet recording apparatus employing the invention in which it is surely detected whether ink drops are ejected from the nozzle orifices when the inspection for the ejecting condition is performed, and in which the condition of nozzle orifices is invariable after the inspection for the ejecting condition is performed, with reference to FIGS. 13 to 17.

Incidentally, the same reference numerals are given to similar and corresponding components shown in the second embodiment of the invention (shown in FIGS. 6 to 12) with the omission of detailed description thereof.

Figure 13:
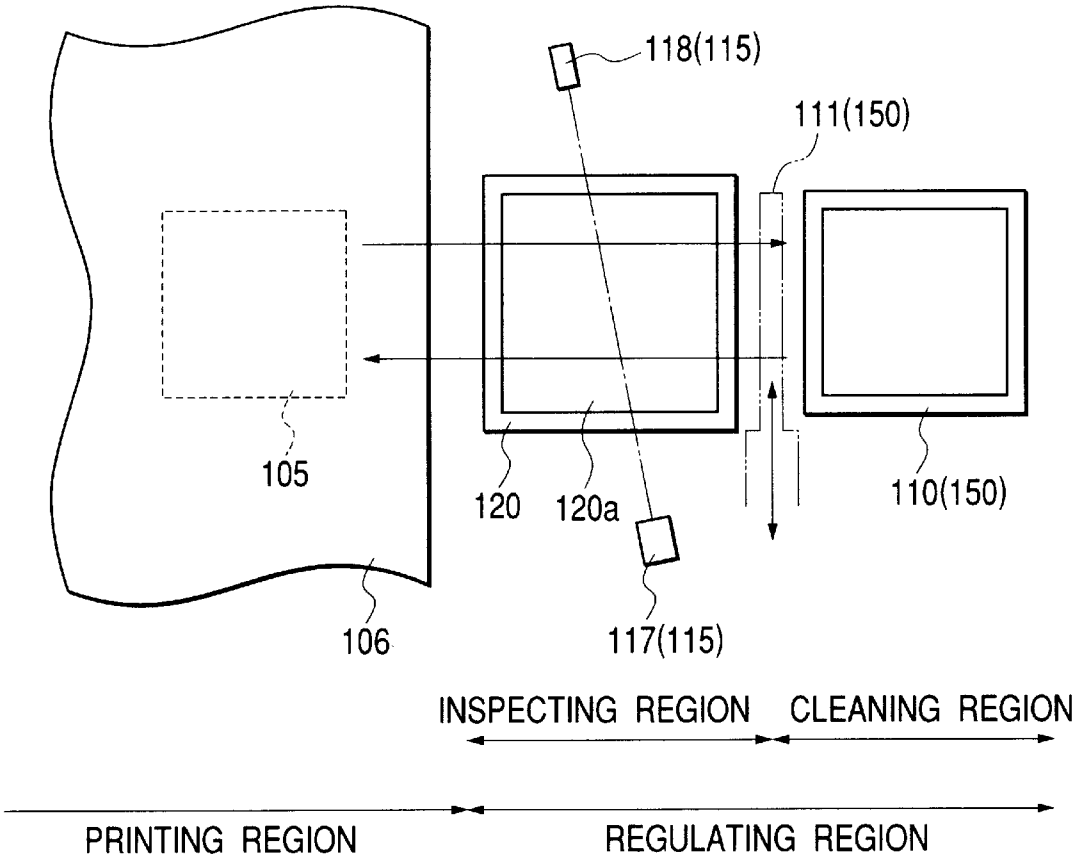
FIG. 13 is a diagram illustrative of positional relationships among a platen, the dot-omission detector, a waste ink receiver, and a head cap which are installed in the recording apparatus shown in FIG. 6.

FIG. 13 illustrates an arrangement of the recording apparatus in the vicinity of an inspecting region where the inspection for the ejecting condition (hereinafter the inspection for the ejecting condition may be called a dot omission detection) is performed. The dot omission detector 115, a waste ink receptacle 120 and a cleaner 150 are provided under the guide member 104 on the outer side (on the right side in FIG. 6) of a printing region. The waste ink receptacle 120 has an ejecting region 120*a*. This waste ink receptacle 120 may needless to say employ the ink collecting unit described in the preceding embodiment of the invention.

In FIG. 13, the head cap 110 and the wiper 111 of the cleaner 150 are only shown with the omission of the rest. Of the path where the recording head 105 moves along the guide member 104 in the horizontal direction, an area in which the dot omission detector 115, the waste ink receptacle 120 and the head cap 110 are provided is called a regulating region.

The dot omission detector 115 is provided with a light emitting module 117 and a light receiving module 118 and inspects the dot omission by examining a flying condition of ink drops by utilizing these light emitting module 117 and the light receiving module 118. Detailed contents of the inspection made by the dot omission detector 115 will be described later.

The waste ink receptacle 120 is a receptacle for receiving the ink drops ejected from the nozzle orifices when the dot omission occurs. On the base portion of the ejecting region 120*a* of the waste ink receptacle 120, a felt for preventing ink drops from spattering is laid. With respect to the nozzle orifices of the recording head 105, moreover, the flushing operation for ejecting ink drops from the nozzle orifices at predetermined time intervals is performed to prevent an unsatisfactory ejection because of an increase in the viscosity of ink and such flushing is performed above the ejecting region 120*a* of the waste ink receptacle 120. The ink drops ejected then are also received by the waste ink receptacle 120. As the inspection for the ejecting condition is made in an area above the ejecting region 120*a* of the waste ink receptacle 120 (dot omission detector 115), the area above the ejecting region 120*a* of the waste ink receptacle 120 is called an inspecting region.

The head cap 110 is an airtight cap that is used to cover the recording head 105 so as to prevent ink in the nozzle orifices from drying out while printing is not performed. In case where the nozzle orifices are clogged, as a cleaning operation is performed by covering the recording head 105 with the head cap 110 as described later, the area above the head cap 110 out of the moving range of the recording head 105 in the horizontal scanning direction is called a cleaning region.

Figure 14:
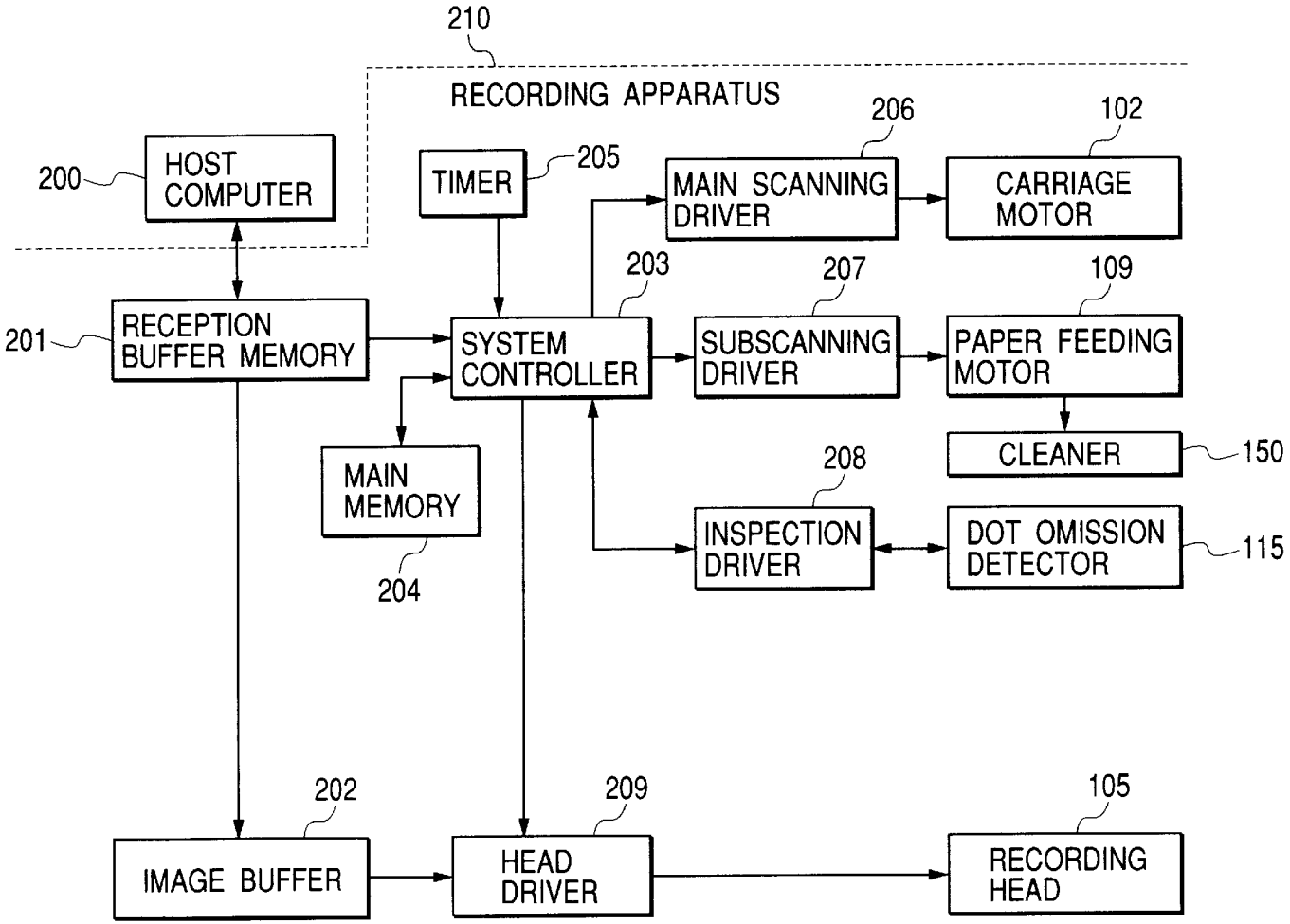
FIG. 14 is a block diagram of an electrical arrangement of the recording apparatus.

FIG. 14 is a block diagram showing an electrical arrangement of a recording apparatus 210. The recording apparatus 210 comprises a reception buffer memory 201 for receiving signals supplied from a host computer 200, an image buffer 202 for storing printing data, a system controller 203 for controlling the whole operation of the recording apparatus 210, a main memory 204 and a timer 205. The system controller 203 is connected to a horizontal scanning driver 206 for driving the carriage motor 102, a vertical scanning driver 207 for driving the paper feeding motor 109, an inspection driver 208 for driving the dot omission detector 115, and a head driver 209 for driving the recording head 105.

The printer driver (not shown) of the host computer 200 determines various parameter values for regulating the printing operation based on the printing mode (a high-speed printing mode, a high-quality printing mode or the like) designated by the user. The printer driver also generates printing data for performing printing in the designated printing mode based on these parameter values and transfers the printing data to the recording apparatus. The printing data thus transferred is stored in the reception buffer memory 201 once. In the printing apparatus 210, the system controller 203 reads necessary information out of the printing data from the reception buffer memory 201 and sends control signals to the respective drivers according to the information.

Printing data on a plurality of color components obtained by analyzing the printing data received by the reception buffer memory 201 on a color component basis is stored in the image buffer 202. The head driver 209 reads the printing data on each color component from the image buffer 202 according to the control signal from the system controller 203 and drives an array of color nozzle orifices provided in the recording head 105.

The flushing operation will now be summarized.

Volatile ingredients tend to evaporate from ink in nozzle orifices to be used with low frequency out of the nozzle orifices provided in the recording head, and while such nozzle orifices are not used, the viscosity of the ink increases little by little, thus causing a phenomenon in which the flying speed of the ejected ink drops is lowered. The nozzle orifices that are unused for a long time may be clogged with extremely viscous ink. Even though nozzle orifices are not clogged with extremely viscous ink yet. the flying speed of the ink drops ejected from some nozzle orifices becomes lowered. As variations in the flying speed of ink drops from every nozzle orifice increases, printing image quality would be impaired. In other words, since recording head ejects ink while moving relative to a printing medium, variations in the flying speed also result in varying the position where ink drops reach the printing medium (landing position, i.e., position where ink dots are formed) and this worsens the printing image quality.

In order to avoid the deterioration of image quality due to the increased viscosity of ink like this, the action called flushing operation (idle jetting) is performed in the recording apparatus 210. This is an action for discharging viscous ink by forcing ink drops to be ejected from the whole nozzle orifice. Preventing ink viscosity from increasing by means of periodic flushing operation makes avoidable the deterioration of image quality due to an increase in ink viscosity.

The ink drops ejected from the nozzle orifices may be unstable after the cleaning operation which will be described later. Either stable condition in which ink drops are satisfactorily ejected or a condition in which no ink is ejected can be established by applying flushing operation to unstable nozzle orifices.

As frequency in use of nozzle orifices is needless to say dependent on images to be printed and also varies complicatedly with the setting of desirable printing quality, printing speed and the like, it is difficult to predict which one of the nozzle orifices causes increased viscosity and when such viscosity occurs. Therefore, flushing operation is intended for the whole nozzle orifice to have ink drops periodically discharged.

Like the normal jetting operation, the flushing operation is performed such that ink drops are ejected by the head driver 209 from nozzle orifices. Consequently, no special mechanism for the flushing operation is provided. However, the ejecting region 120*a* is provided for the waste ink receptacle 120 (dot omission detector 115) in order to receive the ink drops ejected. In other words, flushing operation is performed in the inspecting region (FIG. 13) while the recording head 105 is positioned above the waste ink receptacle 120 (dot omission detector 115).

Subsequently, the cleaning operation will be summarized.

Figure 15:
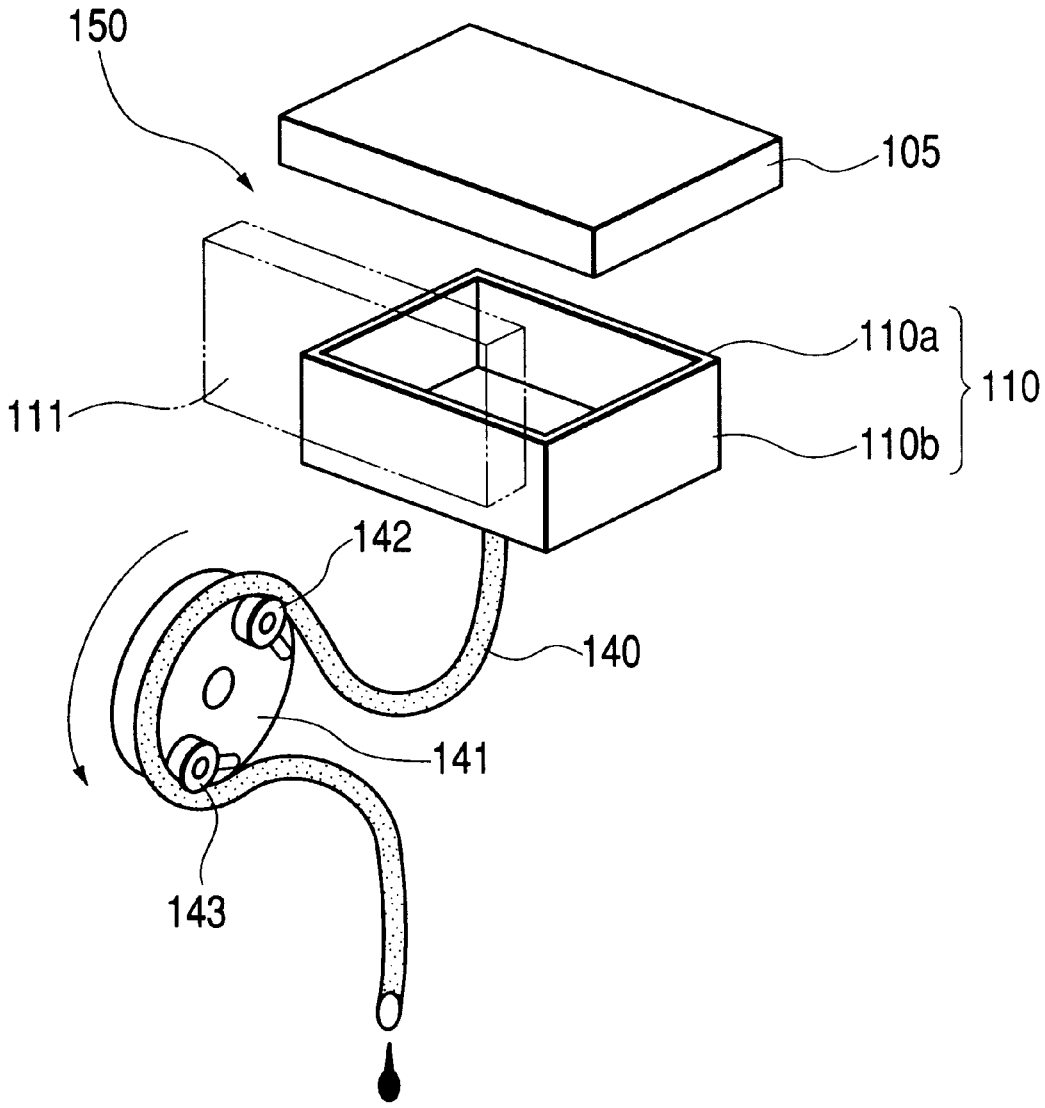
FIG. 15 is a conceptual diagram showing an arrangement of a cleaner.

FIG. 15 is a conceptual drawing showing an arrangement of the cleaner 150. The cleaner 150 is provided with the head cap 110, the wiper 111, a hose 140 and a pump roller 141. The cleaner 150 is provided opposite to the platen 106 with the ejecting region 120*a* of the waste ink receptacle 120 (dot omission detector 115) of FIG. 13 held therebetween. The illustration of the components other than the head cap 110 and the wiper 111 is omitted.

A rubber frame 110*a* is provided on the face of the box body 110*b* of the head cap 110. When the recording head 105 moves to the cleaning region (FIG. 13) in the horizontal scanning direction at the time of performing the cleaning operation, the wiper 111 enters the moving path of the recording head 105 and wipes out the nozzle forming face of the recording head to remove paper powder and dust sticking to the nozzle forming face. Then the head cap 110 moves upward and the rubber frame 110*a* adheres to the nozzle forming face of the recording head 105. Consequently, a closed space is formed with the nozzle forming face of the recording head 105 and the head cap 110.

The pump roller 141 has two small rollers 142 and 143 in the vicinity of its peripheral edge portion. The hose 140 is wound around these two small rollers 142 and 143. When the pump roller 141 is driven by the paper feed motor 109 (FIG. 6) to rotate in the direction of an arrow, air inside the hose 140 is pressed by the small rollers 142 and 143, whereby the closed space within the head cap 110 is evacuated. Consequently, ink is sucked from each nozzle orifice of the recording head 105 and discharged via the hose 140 into a waste ink discharge portion (not shown). Moreover, new ink is supplied from the ink cartridge side into the nozzle orifice when the ink present at the nozzle orifice is discharged.

A processing procedure executed in the recording apparatus will now be described with reference to FIG. 16.

Figure 16:
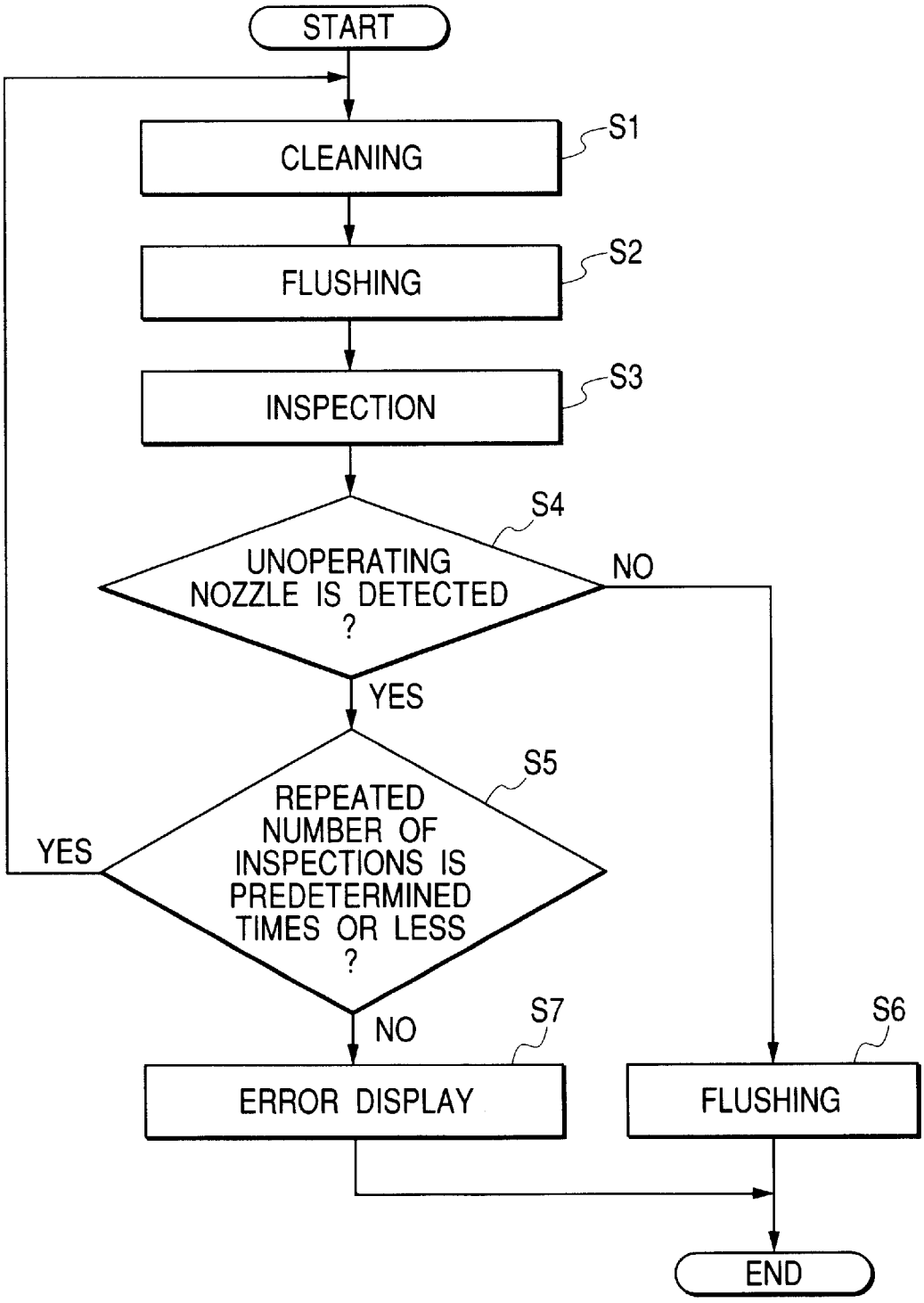
FIG. 16 is a flowchart showing a processing procedure executed in the recording apparatus.

The system controller 203 starts the processing shown in FIG. 16 when recognizes from the timer 205 that a predetermined time or longer has elapsed after a specific event occurred. At Step S1, the recording head 105 is moved from the printing region to the cleaning region as the regulating region where the cleaning operation is performed. After the cleaning operation is performed, the recording head 105 is moved from the cleaning region to the inspecting region. Further, ink drops are ejected (flushing operation) from each of the nozzle orifices in the inspecting region (FIG. 13) above the ejecting region 120*a* of the waste ink receptacle 120 (dot omission detector 115) (Step 82).

When the ejection of a predetermined amount of ink is terminated, the recording head 105 is moved to the printing region once and then the recording head 105 is sent from the printing region to the regulating region again. At Step 53, the inspection for the ejecting condition in each of the nozzle orifices is performed (Step S3) in the inspecting region (FIG. 13) above the ejecting region 120*a* of the dot omission detector 115.

At Step S4, a decision is made on whether any unoperating nozzle orifice (an unoperating nozzle orifice that ejects no ink) is detected. In case where no unoperating nozzle orifices are detected, the number of inspections made is judged at Step S5.

In case where the number of inspections is not greater than a predetermined number, Step S1 is followed again and the cleaning of nozzle orifices is performed in the cleaning region (FIG. 13) and flushing operation is performed (Step S2).

Then the inspection for the ejecting condition is made (Step S3) and a decision is made on whether any unoperating nozzle orifice is detected (Step S4). In case where an unoperating nozzle orifice is detected again, the number of inspections is judged and Step S1 is followed again to repeat the above steps.

In case where no unoperating nozzle orifices are detected Step S4, on the other hand, flushing operation is performed (Step S6) and the processing is terminated.

The number of inspections is judged at Step S5 and in case where the number thereof is greater than the predetermined number, no cleaning is performed and an error is displayed (Step S7) so as to warn the user that maintenance is needed. A display on either recording apparatus side or host computer side may be used to display the error. In other words, even though the cleaning, the flushing operation and the inspection are repeated, for example, five times, the user is warned that maintenance is needed in case where such an unoperating nozzle orifice is detected.

As the flushing operation is performed after the cleaning operation is performed and then the inspection is made, unstable nozzle orifices because of the cleaning operation can be shifted by flushing operation to either operating or unoperating nozzle orifices. Consequently, it is ensured that any unoperating nozzle orifice can be detected by the inspection for the ejecting condition.

Another processing procedure will now be described with reference to FIG. 17. The processing procedure is different from what is shown in FIG. 16 in that the first inspection is performed not after the cleaning and flushing operations are performed.

Figure 17:
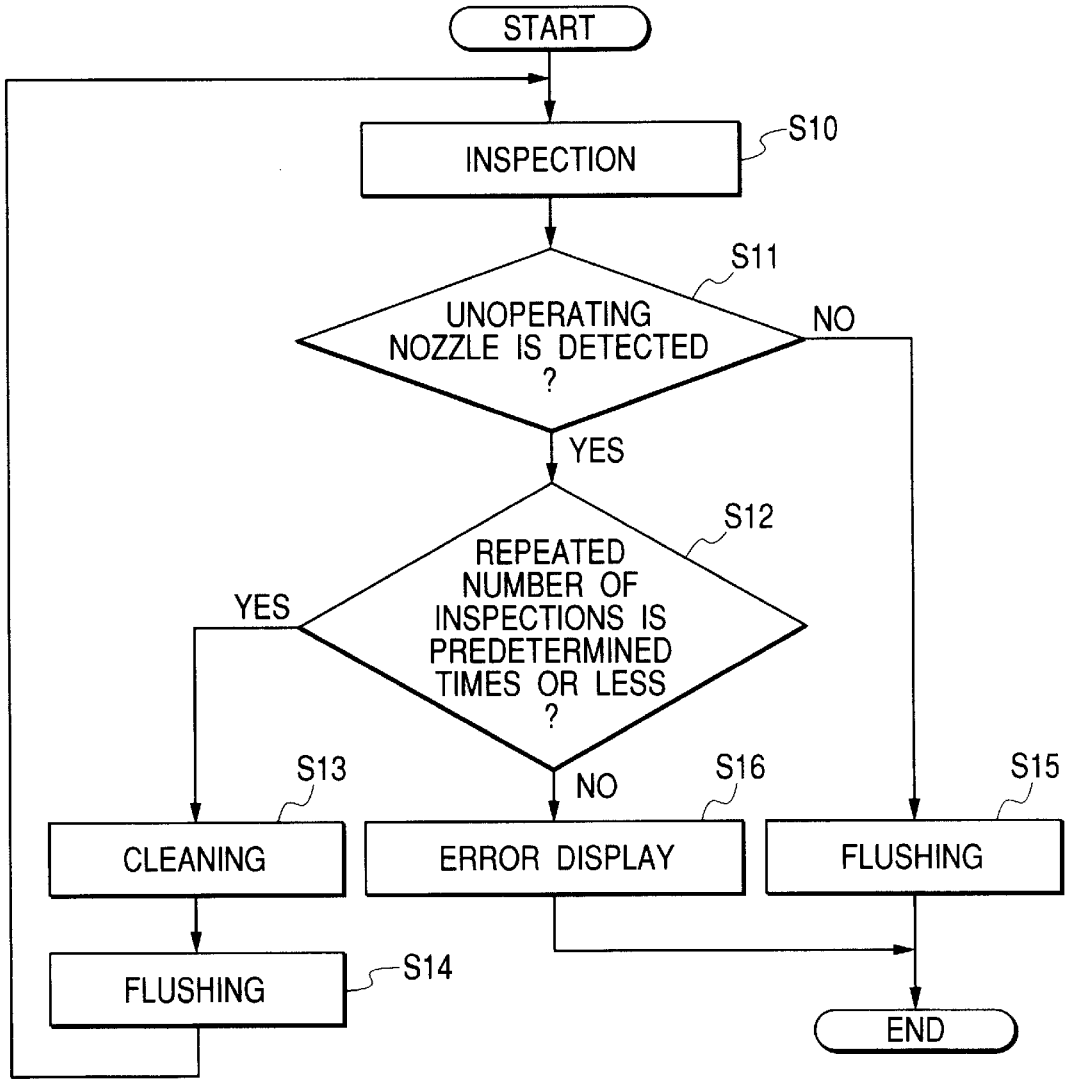
FIG. 17 is a flowchart showing another processing procedure executed in the recording apparatus.

The system controller 203 starts the processing shown in FIG. 17 when recognizes from the timer 205 that a predetermined time or longer has elapsed after a specific event occurred. Namely, the recording head 105 is moved from the printing region to the inspecting region as the regulating region. Then the ink drops ejected from each of the nozzle orifices is inspected in the inspecting region (FIG. 13) above the ejecting region 120*a* of the waste ink receptacle 120 (dot omission detector 115) (Step S10).

Further, a decision is made on whether any unoperating nozzle orifice is detected as a result of the inspection for the ejecting condition (Step S11).

In case where an unoperating nozzle orifices are detected, the number of inspections is judged at Step S12 and in case where the number of inspections is not greater than the predetermined number, the cleaning of nozzle orifices is performed (Step S13) in the cleaning region (FIG. 13) and flushing operation is performed (Step S14) and then Step S10 is followed again so as to make the ink-drop inspection again (Step S10).

In case where no unoperating nozzle orifices are detected at Step 11, on the other hand, flushing operation is performed (Step S15) and the processing is terminated.

As in the processing shown in FIG. 16, the number of inspections is judged at Step S12 and in case where the number thereof is greater than the predetermined number, no cleaning is performed and an error is displayed (Step S7) so as to warn the user that maintenance is needed (Step S16). A display on either recording apparatus side or host computer side may be used to display the error.

In other words, even though the cleaning operation, the flushing operation and the inspection are repeated, for example, five times, the user is warned that maintenance is needed in case where. such an unoperating nozzle orifice is detected.

The flushing operation is performed after the cleaning operation is performed in case where any unoperating nozzle orifice exists as a result of the inspection for the ejecting condition and then the inspection is made again, whereby unstable nozzle orifices because of the cleaning operation can be shifted by flushing operation to either operating or unoperating nozzle orifices. Consequently, it is ensured that any unoperating nozzle orifice can be detected in the inspection for the ejecting condition.

These processing are practically performed under the control of the system controller 203 (FIG. 14) for controlling the carriage motor 102, the dot omission detector 115 and the recording head 105 via the respective drivers. The system controller 203 thus controls the carriage motor 102, the dot omission detector 115 and the recording head 105 according to the program given which is stored in the main memory 204. Although the program is stored in the main memory 204 at the time of performing the processing above according to this embodiment, the system controller 203 may control the carriage motor 102, the dot omission detector 115 and the recording head 105 according to the program stored in the main memory of the host computer 200 (FIG. 14). Moreover, the program may be stored in the hard disk of the host computer 200 before the program is stored in the memory at the time of executing the program. Further, the program can be recorded in a carriable recording medium other than what is fixedly installed: namely, a flash memory, a floppy disk, a CD-ROM, a CD-RW or the like. The program may also be stored in a recording medium connected directly or via a computer to a network. In other words, any kind of recording medium capable of recording the control program may be used.

The waste ink receptacle 120 used in this embodiment can effectively collect the ink mist produced at the time of flushing operation by the use of the ink collecting unit employed in the first and second embodiments.

As set forth above, the ink jet recording apparatus according to this embodiment so arranged that flushing operation is performed after the termination of cleaning operation and then the presence or absence of ink drop ejection from the nozzle orifices is detected by the inspecting region. Therefore, any unstable nozzle orifice, if any, can be shifted to a condition in which ink is not ejected completely during flushing operation or ink is satisfactorily ejected. Consequently, the condition of the nozzle orifice is never changed after the ink inspection is made to ensure that the presence or absence of ink ejection detected by the inspection for the ejecting condition.

What is claimed is:

1. An ink jet recording apparatus, comprising:

a carriage, which moves in a widthwise direction of recording paper;

an ink jet recording head, mounted on the carriage and provided with nozzle orifices for ejecting ink drops to form an image on the recording paper; and an ink collecting unit, placed on a moving path of the recording head for receiving ink drops ejected from the recording head to which a flushing drive signal is supplied; the ink collecting unit including:

an unit box, formed with an aperture through which the ink drops ejected from the recording head to which the flushing drive signal is supplied;

an air flow passage; and a ventilation fan, placed on the way of the air flow passage or a termination end portion of the air flow passage.

2. The recording apparatus as set forth in claim 1, wherein the air flow passage extends meandering in a vertical direction.

3. The recording apparatus as set forth in claims 1 or 2, wherein a plurality of plate members are provided in the air flow passage so as to increase a surface area of the air flow passage.

4. The recording apparatus as set forth in claim 3, wherein the plate members are alternately extended from side walls of the air flow passage to constitute an air flow passage meandering in a horizontal direction.

5. The recording apparatus as set forth in claim 4, wherein a leading end portion of each plate member is slanted toward the gravitational direction.

6. The recording apparatus as set forth in claim 4, wherein the plate members are provided in the air flow passage which extends in the counter-gravitational direction.

7. An ink jet recording apparatus, comprising:

a carriage, which moves in a widthwise direction of recording paper;

an ink jet recording head, mounted on the carriage and provided with nozzle orifices for electing ink drops to form an image on the recording paper; and an unit box, placed on a moving path of the recording head for receiving ink drops ejected from the recording head to which a flushing drive signal is supplied, the unit box formed with an aperture through which the ink drops ejected from the recording head to which the flushing drive signal is supplied, and an air flow passage, which extends meandering in a plurality of directions.

8. The recording apparatus as set forth in claim 7, wherein the air flow passage extends meandering in a vertical direction.

9. An ink jet recording apparatus, comprising:

a carriage, which moves in a widthwise direction of recording paper;

an ink jet recording head, mounted on the carriage and provided with nozzle orifices for ejecting ink drops to form an image on the recording paper;

an ejecting condition detector, placed on a moving path of the recording head, the ejecting condition detector including:

a light emitting module and a light receiving module, which detects an ejecting condition of ink drops ejected from the nozzle orifices; and an ink ejecting region, placed between the light emitting module and the light receiving module for receiving ink drops ejected from the recording head; and a unit box, which faces to the ink ejecting region for collecting ink in the ink ejecting region, the unit box formed with an air flow passage therein, wherein a plurality of plate members are provided in the air flow passage so as to increase a surface area of the air flow passage.

10. The recording apparatus as set forth in claim 9, wherein the unit box is formed with an aperture through which ink drops ejected from the recording head to which a flushing drive signal is supplied; and wherein the air flow passage extends meandering in a vertical direction.

11. The recording apparatus as set forth in any one of claims 2, 8, and 10, wherein each bottom portion of the air flow passage meandering in the vertical direction has a guide port communicated with the ink collecting space for guiding waste ink thereto.

12. The recording apparatus as set forth in claim 9, wherein the unit box is provided with a ventilation fan disposed on the way of the air flow passage or a termination end portion of the air flow passage.

13. The recording apparatus as set forth in any one of claims 1, 7 and 9, wherein the air flow passage extends from the aperture while meandering in a gravitational direction and a counter-gravitational direction.

14. The recording apparatus as set forth in any one of claims 1, 7 and 9, wherein the air flow passage extends from the aperture toward a counter-gravitational direction while an ink collecting space is formed so as to extend from the aperture in the gravitational direction.

15. The recording apparatus as set forth in claim 14, wherein the ink collecting space has a bottom formed with a discharging port from which collected waste ink is discharged.

16. The recording apparatus as set forth in any one of claims 1, 7 and 9, wherein an air filter is disposed in a part of the air flow passage.

17. The recording apparatus as set forth in claim 16, wherein the air filter is disposed in the vicinity of the ventilation fan.

18. The recording apparatus as set forth in any one of claims 1, 7 and 9, wherein the unit box includes:

a side wall;

a peripheral wall, which extends perpendicularly from the side wall to define a box body in which a side opposing to the side wall is opened;

internal walls, which define the air flow passage; and a sealing member, which closes the opened side of the box body.

19. The recording apparatus as set forth in claim 18, wherein a thermally fusible member is provided as the sealing member.

20. The recording apparatus as set forth in claim 9, wherein a plurality of ink shading walls, each having a light transmission hole, are disposed between the light emitting module and the light receiving module.

21. The recording apparatus as set forth in claim 20, wherein a plurality of partition walls are disposed between a pair of ink shading walls which define the ink ejecting region.

22. The recording apparatus as set forth in claim 21, wherein a cutout portion is formed on a head-side edge portion of each partition wall to form an air flow in the vicinity of the light transmission hole.

23. The recording apparatus as set forth in claim 22, wherein each partition wall is formed with an ink guide for guiding ink from the outside of the ink ejecting region to the inside of the ink ejecting region.

24. The recording apparatus as set forth in claim 20, wherein an ink discharging port is formed in each internal space defined by the respective ink shading walls for discharging ink therefrom.

25. The recording apparatus as set forth in claim 24, wherein the internal space is placed in the vicinity of the light emitting module.

26. The recording apparatus as set forth in claim 20, wherein a size of the light transmission hole situated downwards is smaller than a size of the light transmission hole situated upwards.

27. The recording apparatus as set forth in claim 20, wherein a recessed portion is formed on a head-side edge portion of each ink shading wall.

28. The recording apparatus as set forth in claim 9, wherein the plate members are alternately extended from side walls of the air flow passage to constitute an air flow passage meandering in a horizontal direction.

29. The recording apparatus as set forth in claim 28, wherein a leading end portion of each plate member is slanted toward the gravitational direction.

30. The recording apparatus as set forth in claim 28, wherein the plate members are provided in the air flow passage which extends in the counter-gravitational direction.

31. An ink jet recording apparatus, comprising:

a carriage, which moves in a widthwise direction of recording paper;

an ink jet recording head, mounted on the carriage and provided with a nozzle forming face on which nozzle orifices are formed;

a head driver, which drives the recording head so as to eject ink drops from the nozzle orifices to form an image on the recording paper;

a scanning driver, which moves the recording head in a main scanning direction;

an ejecting condition detector, which performs an inspection in which it is detected whether ink drops are ejected from the nozzle orifices;

a cleaner, which performs a cleaning operation in which negative pressure is applied to the nozzle orifices to discharge ink therefrom and the nozzle forming face is wiped with a wiper; and a controller, which supplies a flushing drive signal to the head driver to eject ink drops from the nozzle orifices, after the cleaner performs the cleaning operation and before the ejecting condition detector performs the inspection.

32. The recording apparatus as set forth in claim 31, wherein when an unoperating nozzle is detected as a result of the inspection, the cleaner performs the cleaning operation, the controller then supplies the flushing signal to the recording head, and the ejecting condition detector then performs the inspection.

33. The recording apparatus as set forth in claim 31, further comprising an ink collecting unit which faces to the ejecting condition detector and includes a unit box formed with an aperture through which ink drops ejected from the recording head to which the flushing drive signal is supplied, an air flow passage formed in the unit box, and a ventilation fan disposed on the way of the air flow passage or a termination end portion of the air flow passage.

34. The recording apparatus as set forth in claim 31, wherein the controller supplies the flushing drive signal after the ejecting condition detector performs the inspection.

35. The recording apparatus as set forth in claim 31, wherein the controller displays an error indication when a predetermined number of inspections are repeated by the ejecting condition detector.

36. The recording apparatus as set forth in claim 35, wherein the error indication is displayed on the recording apparatus or a host computer to which the recording apparatus is connected.

37. An inspection method used in a recording apparatus, comprising: a carriage, which moves in a widthwise direction of recording paper, an ink jet recording head, mounted on the carriage and provided with a nozzle forming face on which nozzle orifices are formed; a head driver, which drives the recording head so as to eject ink drops from the nozzle orifices to form an image on the recording paper, and a scanning driver, which moves the recording head in a main scanning direction, the method comprising the steps of:

performing a cleaning operation in which negative pressure is applied to the nozzle orifices to discharge ink therefrom and the nozzle forming face is wiped with a wiper;

supplying a flushing drive signal to the head driver to eject ink drops from the nozzle orifices, after the cleaning operation is performed; and performing an inspection in which it is detected whether ink drops are ejected from the nozzle orifices, after the flushing operation is performed.

38. The inspection method as set forth in claim 37, further comprising the steps of:

performing the cleaning operation when an unoperating nozzle is detected as a result of the inspection;

supplying the flushing drive signal to the head driver after the cleaning operation is performed; and performing the inspection after the flushing operation is performed.

39. The inspection method as set forth in claim 37, further comprising the step of supplying the flushing drive signal after the inspection is performed.

40. The inspection method as set forth in claim 37, further comprising the step of displaying an error indication when a predetermined number of the inspections are repeated.

41. The inspection method as set forth in claim 40, wherein the error indication is displayed on the recording apparatus or a host computer to which the recording apparatus is connected.

* * * * *